US008717265B2

(12) United States Patent
Lee

(10) Patent No.: US 8,717,265 B2
(45) Date of Patent: May 6, 2014

(54) STAGGERED LINE INVERSION AND POWER REDUCTION SYSTEM AND METHOD FOR LCD PANELS

(75) Inventor: Yongman Lee, Pleasanton, CA (US)

(73) Assignee: Apple Inc., Cupertino, CA (US)

( * ) Notice: Subject to any disclaimer, the term of this patent is extended or adjusted under 35 U.S.C. 154(b) by 1111 days.

(21) Appl. No.: 12/704,349

(22) Filed: Feb. 11, 2010

(65) Prior Publication Data

US 2010/0265235 A1 Oct. 21, 2010

Related U.S. Application Data

(60) Provisional application No. 61/170,944, filed on Apr. 20, 2009.

(51) Int. Cl.
*G09G 3/36* (2006.01)

(52) U.S. Cl.
USPC ..... 345/87; 345/96; 345/103; 345/209; 345/211

(58) Field of Classification Search
USPC ..... 345/87–103, 209–211, 690
See application file for complete search history.

(56) References Cited

U.S. PATENT DOCUMENTS

| | | | | |
|---|---|---|---|---|
| 2001/0038370 | A1 | 11/2001 | Yeung | |
| 2004/0178977 | A1* | 9/2004 | Nakayoshi et al. | 345/87 |
| 2004/0196241 | A1* | 10/2004 | Lee et al. | 345/94 |
| 2005/0253829 | A1 | 11/2005 | Mamba et al. | |
| 2006/0007094 | A1* | 1/2006 | Kang et al. | 345/98 |
| 2006/0274011 | A1 | 12/2006 | Igarashi et al. | |
| 2007/0001978 | A1* | 1/2007 | Cho | 345/98 |
| 2008/0074377 | A1 | 3/2008 | Fujita et al. | |
| 2008/0297673 | A1 | 12/2008 | Takahashi | |
| 2009/0160346 | A1 | 6/2009 | Lee | |
| 2009/0273550 | A1 | 11/2009 | Vieri et al. | |
| 2010/0073332 | A1 | 3/2010 | Gettemy et al. | |
| 2010/0073350 | A1 | 3/2010 | Lee | |

FOREIGN PATENT DOCUMENTS

| | | | |
|---|---|---|---|
| EP | 1143406 | | 10/2001 |
| JP | 2005-300948 | A | 10/2005 |
| JP | 2008-298904 | A | 12/2008 |
| KR | 10-2005-0000646 | A | 6/2005 |
| KR | 10-2005-0097036 | A | 7/2005 |
| KR | 10-2006-0039873 | A | 6/2006 |
| KR | 10-2008-0028301 | A | 6/2006 |

OTHER PUBLICATIONS

Korean Search Report for Korean Application No. 10-2011-7027589 dated Dec. 22, 2011, 13 pgs.
European Examination Report for EP107614538.5 dated Aug. 6, 2013, 8 pgs.

* cited by examiner

*Primary Examiner* — Hong Zhou
(74) *Attorney, Agent, or Firm* — Fletcher Yoder PC

(57) ABSTRACT

Systems and methods are disclosed for various inversion techniques for an LCD array, such as a staggered 2-line inversion, a staggered 1-line inversion, or a staggered N-line inversion. The staggered inversion may invert 2-lines, 1-line or N-lines of an array over the duration of a frame displayed on the array. Additional systems and methods may include a high impedance power reduction technique that may be applied alone or in combination with the various inversion techniques. Specifically, electrode drivers for "idle" lines of a staggered 1-line, 2-line, or N-line inversion may be switched to a high impedance state such that the corresponding drivers for the idle lines use reduced power during the inversion of the "active" lines.

24 Claims, 15 Drawing Sheets

STAGGERED LINE INVERSION AND POWER REDUCTION SYSTEM AND METHOD FOR LCD PANELS

CROSS REFERENCE TO RELATED APPLICATIONS

This application is a Non-Provisional Patent Application claiming priority to U.S. Provisional Patent Application No. 61/170,944, entitled "STAGGERED LINE INVERSION AND POWER REDUCTION SYSTEM AND METHOD FOR LCD PANELS", filed Apr. 20, 2009, which is herein incorporated by reference in its entirety.

BACKGROUND

The present disclosure relates generally to power management and refreshing the pixels of a liquid crystal display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art Electronic devices increasingly include display screens as part of the user interface of the device. As may be appreciated, the display screens may be employed in a wide array of devices, including desktop computer systems, notebook computers, handheld computing devices, cellular phones and portable media players. Liquid crystal display (LCD) panels have become increasingly popular for use in these devices. This popularity can be attributed to their light weight and thin profile, as well as the relatively low power it takes to operate the pixels of the LCD's to generate images on the LCD.

For any given pixel of an LCD monitor, the amount of light that is viewable on the LCD depends on the voltage applied to the pixel. However, applying a single direct current (DC) voltage could eventually damage the pixels of the display. Thus, in order to prevent such possible damage, LCD's typically alternate, or invert, the voltage applied to the pixels between positive and negative DC values for each pixel. This inversion results in an overall average DC voltage of zero over time, with no loss in brightness because the root mean square of the voltage can be chosen to be the same for both the positive and negative DC values.

This inversion may be done on a line-by-line basis to refresh the voltage of the LCD, creating line inversion refreshes for the LCD. Similarly, LCDs typically refresh the panel by switching the polarity for each line and transmitting the necessary voltage to each pixel, in effect, redrawing the panel on a line by line basis for each cycle of refresh (typically 60 Hz). In other types of LCD's, the inversion may be done on a "frame" basis so that the entire frame is held at one polarity for one cycle, such that all lines (rows) are redrawn from the first line to the last line, and then switched to the opposite polarity for the next cycle, again redrawing from the first line of the panel to the last line. In a frame refresh, the polarity of the "frame" is switched every cycle (e.g., 60 times per second for a 60 Hz refresh rate). Depending on the type of LCD panel, some refresh techniques may result in undesirable artifacts or visual effects. Further, as the demand for portable devices continues to grow, there is a need for LCD inversion techniques and image refreshing techniques that consume less power.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Systems and methods are disclosed for various inversion techniques such as a staggered 2-line inversion, a staggered 1-line inversion, or a staggered N-line inversion. The staggered inversion may invert 2-lines, 1-line or N-lines of an array over the duration of a frame displayed on the array. Additional systems and methods may include a high impedance power reduction technique that may be applied alone or in combination with the various inversion techniques. Specifically, electrode drivers for "idle" lines of a staggered 1-line, 2-line, or N-line inversion may be switched to a high impedance state such that the corresponding drivers for the idle lines use reduced power during the inversion of the "active" lines.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure relates to reducing visual artifacts and power usage of an LCD panel. In accordance with the present disclosure, the LCD panel may include an array having various inversion techniques, such as a staggered 2-line inversion, a staggered 1-line inversion, or a staggered N-line inversion. A high impedance power reduction technique may be applied alone or in combination with the various inversion techniques. Specifically, electrode drivers for "idle" lines of a staggered inversion may be switched to a third high impedance state such that these drivers use reduced power during the inversion of the active lines.

Figure 1:
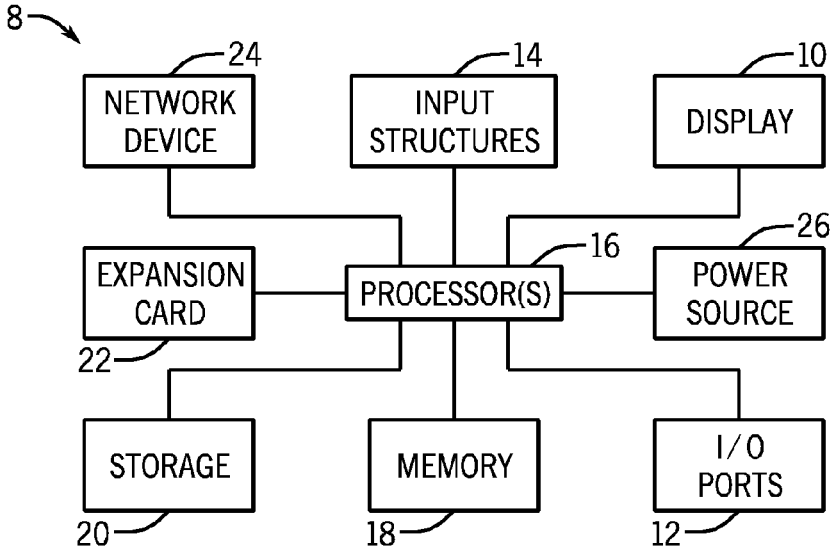
FIG. 1 is a block diagram of exemplary components of an electronic device, in accordance with aspects of the present disclosure.
Figure 3:
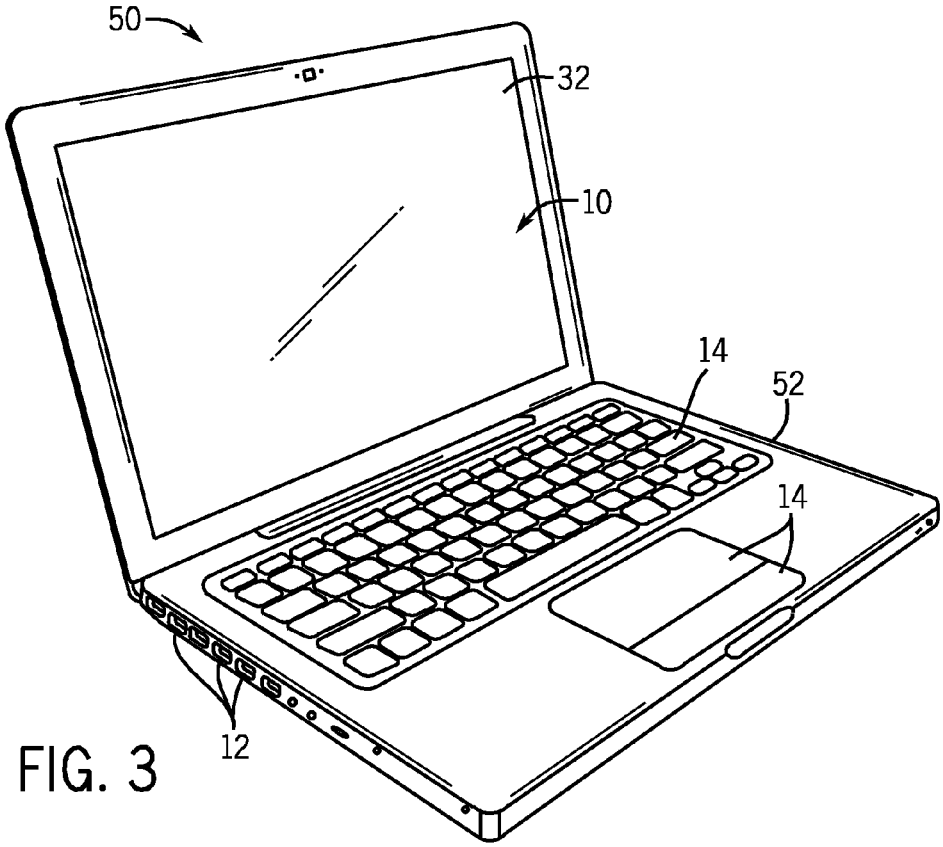
FIG. 3 is a view of a computer in accordance with aspects of the present disclosure.
Figure 2:
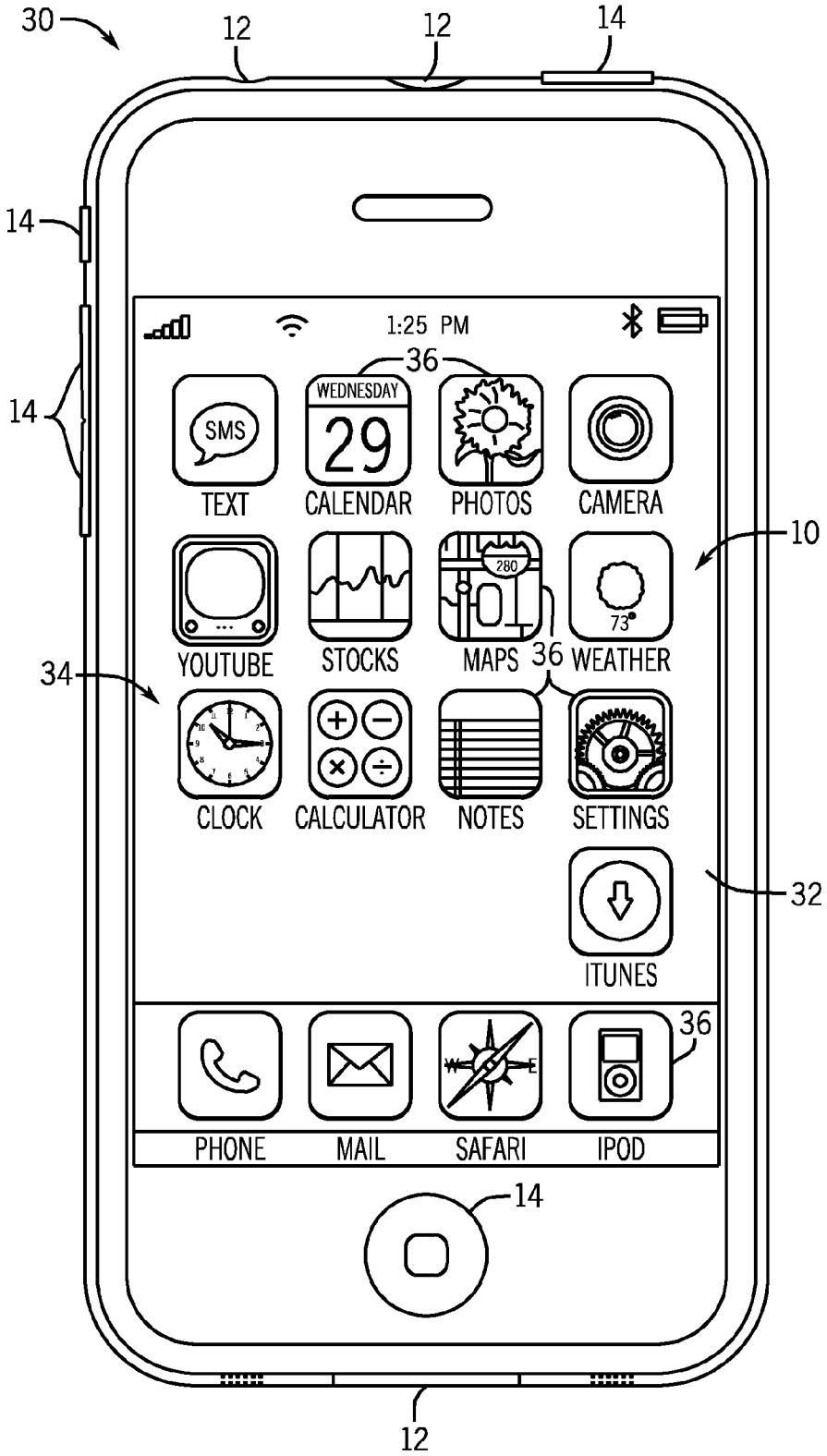
FIG. 2 is a front view of a handheld electronic device in accordance with aspects of the present disclosure.

With these foregoing features in mind, a general description of suitable electronic devices using LCD displays having such features is provided below. In FIG. 1, a block diagram depicting various components that may be present in electronic devices suitable for use with the present techniques is provided. In FIG. 2, one example of a suitable electronic device, here provided as a handheld electronic device, is depicted. In FIG. 3, another example of a suitable electronic device, here provided as a computer system, is depicted. These types of electronic devices, and other electronic devices providing comparable display capabilities, may be used in conjunction with the present techniques.

An example of a suitable electronic device may include various internal and/or external components which contribute to the function of the device. FIG. 1 is a block diagram illustrating the components that may be present in such an electronic device 8 and which may allow the device 8 to function in accordance with the techniques discussed herein. Those of ordinary skill in the art will appreciate that the various functional blocks shown in FIG. 1 may include hardware elements (including circuitry), software elements (including computer code stored on a computer-readable medium) or a combination of both hardware and software elements. It should further be noted that FIG. 1 is merely one example of a particular implementation and is merely intended to illustrate the types of components that may be present in a device 8. For example, in the presently illustrated embodiment, these components may include a display 10, I/O ports 12, input structures 14, one or more processors 16, a memory device 18, a non-volatile storage 20, expansion card (s) 22, a networking device 24, and a power source 26.

With regard to each of these components, the display 10 may be used to display various images generated by the device 8. In one embodiment, the display 10 may be a liquid crystal display (LCD). For example, the display 10 may be an LCD employing fringe field switching (FFS), in-plane switching (IPS), or other techniques useful in operating such LCD devices. Additionally, in certain embodiments of the electronic device 8, the display 10 may be provided in conjunction with a touch-sensitive element, such as a touch-screen, that may be used as part of the control interface for the device 8.

The I/O ports 12 may include ports configured to connect to a variety of external devices, such as a power source, headset or headphones, or other electronic devices (such as handheld devices and/or computers, printers, projectors, external displays, modems, docking stations, and so forth). The I/O ports 12 may support any interface type, such as a universal serial bus (USB) port, a video port, a serial connection port, an IEEE-1394 port, an Ethernet or modem port, and/or an AC/DC power connection port.

The input structures 14 may include the various devices, circuitry, and pathways by which user input or feedback is provided to the processor 16. Such input structures 14 may be configured to control a function of the device 8, applications running on the device 8, and/or any interfaces or devices connected to or used by the electronic device 8. For example, the input structures 14 may allow a user to navigate a displayed user interface or application interface. Examples of the input structures 14 may include buttons, sliders, switches, control pads, keys, knobs, scroll wheels, keyboards, mice, touchpads, and so forth.

In certain embodiments, an input structure 14 and display 10 may be provided together, such an in the case of a touch-screen where a touch sensitive mechanism is provided in conjunction with the display 10. In such embodiments, the user may select or interact with displayed interface elements via the touch sensitive mechanism. In this way, the displayed interface may provide interactive functionality, allowing a user to navigate the displayed interface by touching the display 10.

User interaction with the input structures 14, such as to interact with a user or application interface displayed on the display 10, may generate electrical signals indicative of the user input. These input signals may be routed via suitable pathways, such as an input hub or bus, to the processor(s) 16 for further processing.

The processor(s) 16 may provide the processing capability to execute the operating system, programs, user and application interfaces, and any other functions of the electronic device 8. The processor(s) 16 may include one or more microprocessors, such as one or more "general-purpose" microprocessors, one or more special-purpose microprocessors and/or ASICS, or some combination of such processing components. For example, the processor 16 may include one or more reduced instruction set (RISC) processors, as well as graphics processors, video processors, audio processors and/or related chip sets.

The instructions or data to be processed by the processor(s) 16 may be stored in a computer-readable medium, such as a memory 18. Such a memory 18 may be provided as a volatile memory, such as random access memory (RAM), and/or as a non-volatile memory, such as read-only memory (ROM). The memory 18 may store a variety of information and may be used for various purposes. For example, the memory 18 may store firmware for the electronic device 8 (such as a basic input/output instruction or operating system instructions), various programs, applications, or routines executed on the electronic device 8, user interface functions, processor functions, and so forth. In addition, the memory 18 may be used for buffering or caching during operation of the electronic device 8.

The components may further include other forms of computer-readable media, such as a non-volatile storage 20, for persistent storage of data and/or instructions. The non-volatile storage 20 may include flash memory, a hard drive, or any other optical, magnetic, and/or solid-state storage media. The non-volatile storage 20 may be used to store firmware, data files, software, wireless connection information, and any other suitable data.

The embodiment illustrated in FIG. 1 may also include one or more card or expansion slots. The card slots may be configured to receive an expansion card 22 that may be used to add functionality, such as additional memory, I/O functionality, or networking capability, to the electronic device 8. Such an expansion card 22 may connect to the device through any type of suitable connector, and may be accessed internally or external to the housing of the electronic device 8. For example, in one embodiment, the expansion card 22 may be a flash memory card, such as a SecureDigital (SD) card, mini- or microSD, CompactFlash card, Multimedia card (MMC), or the like.

The components depicted in FIG. 1 also include a network device 24, such as a network controller or a network interface card (NIC). In one embodiment, the network device 24 may be a wireless NIC providing wireless connectivity over any 802.11 standard or any other suitable wireless networking standard. The network device 24 may allow the electronic device 8 to communicate over a network, such as a Local Area Network (LAN), Wide Area Network (WAN), or the Internet. Further, the electronic device 8 may connect to and send or receive data with any device on the network, such as portable electronic devices, personal computers, printers, and so forth. Alternatively, in some embodiments, the electronic device 8 may not include a network device 24. In such an embodiment, a NIC may be added as an expansion card 22 to provide similar networking capability as described above.

Further, the components may also include a power source 26. In one embodiment, the power source 26 may be one or more batteries, such as a lithium-ion polymer battery or other type of suitable battery. The battery may be user-removable or may be secured within the housing of the electronic device 8, and may be rechargeable. Additionally, the power source 26 may include AC power, such as provided by an electrical outlet, and the electronic device 8 may be connected to the power source 26 via a power adapter. This power adapter may also be used to recharge one or more batteries if present.

With the foregoing in mind, FIG. 2 illustrates an electronic device 8 in the form of a handheld device 30, here a cellular telephone. It should be noted that while the depicted handheld device 30 is provided in the context of a cellular telephone, other types of handheld devices (such as media players for playing music and/or video, personal data organizers, handheld game platforms, and/or combinations of such devices) may also be suitably provided as the electronic device 8. Further, a suitable handheld device 30 may incorporate the functionality of one or more types of devices, such as a media player, a cellular phone, a gaming platform, a personal data organizer, and so forth.

For example, in the depicted embodiment, the handheld device 30 is in the form of a cellular telephone that may provide various additional functionalities (such as the ability to take pictures, record audio and/or video, listen to music, play games, and so forth). As discussed with respect to the general electronic device of FIG. 1, the handheld device 30 may allow a user to connect to and communicate through the Internet or through other networks, such as local or wide area networks. The handheld electronic device 30, may also communicate with other devices using short-range connections, such as Bluetooth and near field communication. By way of example, the handheld device 30 may be a model of an iPod® or iPhone® available from Apple Inc. of Cupertino, Calif.

In the depicted embodiment, the handheld device 30 includes an enclosure or body that protects the interior components from physical damage and shields them from electromagnetic interference. The enclosure may be formed from any suitable material such as plastic, metal or a composite material and may allow certain frequencies of electromagnetic radiation to pass through to wireless communication circuitry within the handheld device 30 to facilitate wireless communication.

In the depicted embodiment, the enclosure includes user input structures 14 through which a user may interface with the device. Each user input structure 14 may be configured to help control a device function when actuated. For example, in a cellular telephone implementation, one or more of the input structures 14 may be configured to invoke a "home" screen or menu to be displayed, to toggle between a sleep and a wake mode, to silence a ringer for a cell phone application, to increase or decrease a volume output, and so forth.

In the depicted embodiment, the handheld device 30 includes a display 10 in the form of an LCD 32. The LCD 32 may be used to display a graphical user interface (GUI) 34 that allows a user to interact with the handheld device 30. The GUI 34 may include various layers, windows, screens, templates, or other graphical elements that may be displayed in all, or a portion, of the LCD 32. Generally, the GUI 34 may include graphical elements that represent applications and functions of the electronic device. The graphical elements may include icons 36 and other images representing buttons, sliders, menu bars, and the like. The icons 36 may correspond to various applications of the electronic device that may open upon selection of a respective icon 36. Furthermore, selection of an icon 36 may lead to a hierarchical navigation process, such that selection of an icon 36 leads to a screen that includes one or more additional icons or other GUI elements. The icons 36 may be selected via a touchscreen included in the display 10, or may be selected by another user input structure 14, such as a wheel or button.

The handheld electronic device 30 also may include various input and output (I/O) ports 12 that allow connection of the handheld device 30 to external devices. For example, one I/O port 12 may be a port that allows the transmission and reception of data or commands between the handheld electronic device 30 and another electronic device, such as a computer. Such an I/O port 12 may be a proprietary port from Apple Inc. or may be an open standard I/O port.

In addition to handheld devices 30, such as the depicted cellular telephone of FIG. 2, an electronic device 8 may also take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 8 in the form of a computer may be a model of a MacBook®, MacBook® Pro, MacBook Air®, iMac®, Mac® mini, or Mac Pro® available from Apple Inc. By way of example, an electronic device 8 in the form of a laptop computer 50 is illustrated in FIG. 3 in accordance with one embodiment of the present invention. The depicted computer 50 includes a housing 52, a display 10 (such as the depicted LCD 32), input structures 14, and input/output ports 12.

In one embodiment, the input structures 14 (such as a keyboard and/or touchpad) may be used to interact with the computer 50, such as to start, control, or operate a GUI or applications running on the computer 50. For example, a keyboard and/or touchpad may allow a user to navigate a user interface or application interface displayed on the LCD 32.

As depicted, the electronic device 8 in the form of computer 50 may also include various input and output ports 12 to allow connection of additional devices. For example, the computer 50 may include an I/O port 12, such as a USB port or other port, suitable for connecting to another electronic device, a projector, a supplemental display, and so forth. In addition, the computer 50 may include network connectivity, memory, and storage capabilities, as described with respect to FIG. 1. As a result, the computer 50 may store and execute a GUI and other applications.

With the foregoing discussion in mind, it may be appreciated that an electronic device 8 in the form of either a handheld device 30 or a computer 50 may be provided with an LCD 32 as the display 10. Such an LCD 32 may be utilized to display the respective operating system and application interfaces running on the electronic device 8 and/or to display data, images, or other visual outputs associated with an operation of the electronic device 8.

In embodiments in which the electronic device 8 includes an LCD 32, the LCD 32 may include an array or matrix of picture elements (i.e., pixels). In operation, the LCD 32 generally operates to modulate the transmission of light through the pixels by controlling the orientation of liquid crystal disposed at each pixel. In general, the orientation of the liquid crystals is controlled by varying an electrical field associated with each respective pixel, with the liquid crystals being oriented at any given instant by the properties (strength, shape, and so forth) of the electrical field.

Different types of LCDs may employ different techniques in manipulating these electrical fields and/or the liquid crystals. For example, certain LCDs employ transverse electrical field modes in which the liquid crystals are oriented by applying an in-plane electrical field to a layer of the liquid crystals. Examples of such techniques include in-plane switching (IPS) and fringe field switching (FFS) techniques, which differ in the electrode arrangement employed to generate the respective electrical fields.

While control of the orientation of the liquid crystals in such displays may be sufficient to modulate the amount of light emitted by a pixel, color filters may also be associated with the pixels to allow specific colors of light to be emitted by each pixel. For example, in embodiments where the LCD 32 is a color display, each pixel of a group of pixels may correspond to a different primary color. For example, in one embodiment, a group of pixels may include a red pixel, a green pixel, and a blue pixel, each associated with an appropriately colored filter. The intensity of light allowed to pass through each pixel (by modulation of the corresponding liquid crystals), and its combination with the light emitted from other adjacent pixels, determines what color(s) are perceived by a user viewing the display. As the viewable colors are formed from individual color components (e.g., red, green, and blue) provided by the colored pixels, the colored pixels may also be referred to as unit pixels.

Figure 4:
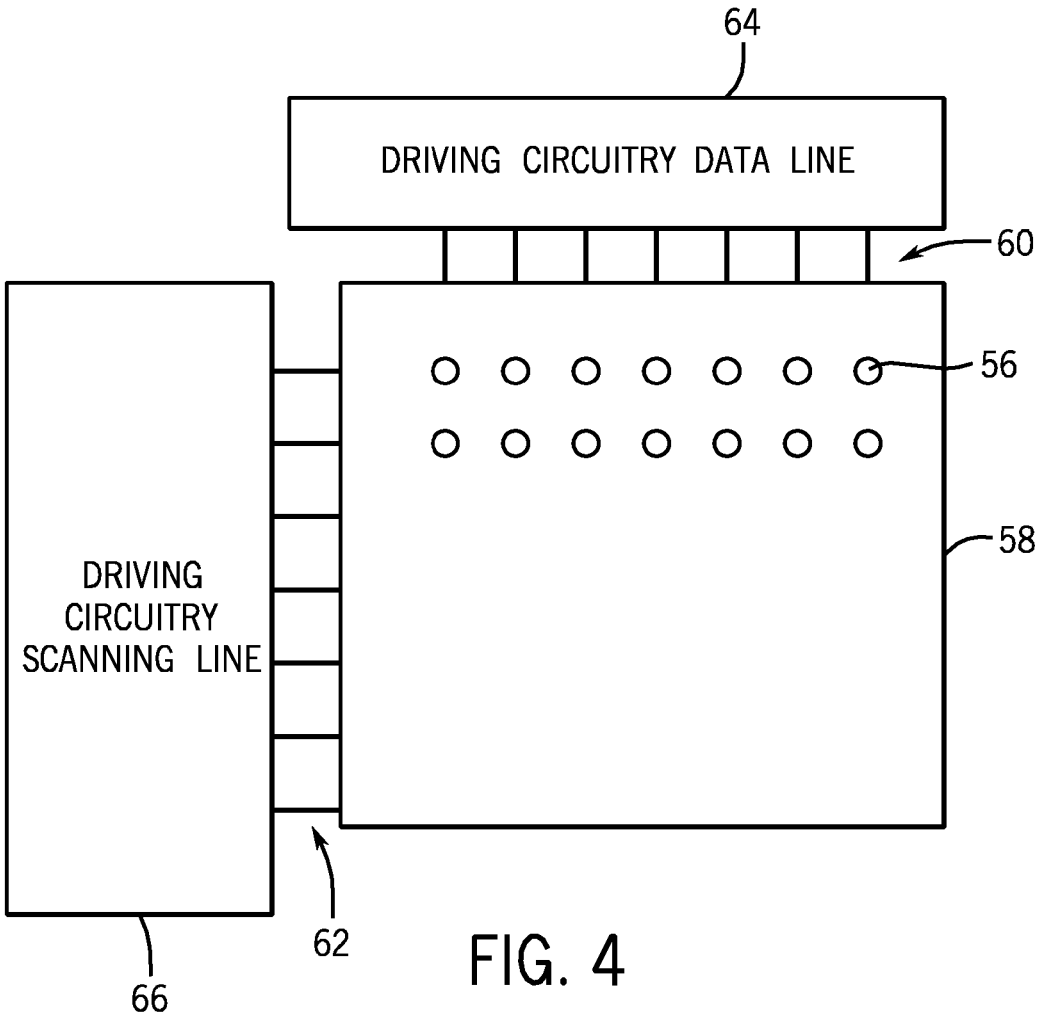
FIG. 4 is a block diagram of switching and display circuitry of LCD pixels, in accordance with aspects of the present disclosure.

Referring now to FIG. 4, an example of a circuit view of pixel driving circuitry found in an LCD 32 is provided. As depicted, pixels 56 may be disposed in an array 58 that forms an image display region of an LCD 32. In such a matrix, each pixel 56 may be defined by the intersection of data lines 60 and scanning or gate lines 62.

As will be appreciated, each pixel 56 includes an access device, such as a thin film transistor (TFT). In the depicted embodiment, each TFT of a pixel 56 may be connected to a data line 60, extending from respective data line driving circuitry 64. Similarly, in the depicted embodiment, the gate of each TFT of a pixel is electrically connected to a scanning or gate line 62, extending from respective scanning line driving circuitry 66.

In one embodiment, the data line driving circuitry 64 sends image signals to the pixels via the respective data lines 60. As described below, such image signals may be applied by a variety of techniques. The scanning lines 62 may apply scanning signals from the scanning line driving circuitry 66 to the gate of each TFT of pixel 56 to which the respective scanning lines 62 connect. Such scanning signals may be applied in various sequences with a predetermined timing and/or in a pulsed manner.

The image signals stored at the pixel electrode may be used to generate an electrical field between the respective pixel electrode and a common electrode. Such an electrical field may align liquid crystals within the liquid crystal layer to modulate light transmission through the liquid crystal layer. In some embodiments, a storage capacitor may also be provided in parallel to the liquid crystal capacitor formed between the pixel electrode and the common electrode to prevent leakage of the stored image signal at the pixel electrode.

Figure 5:
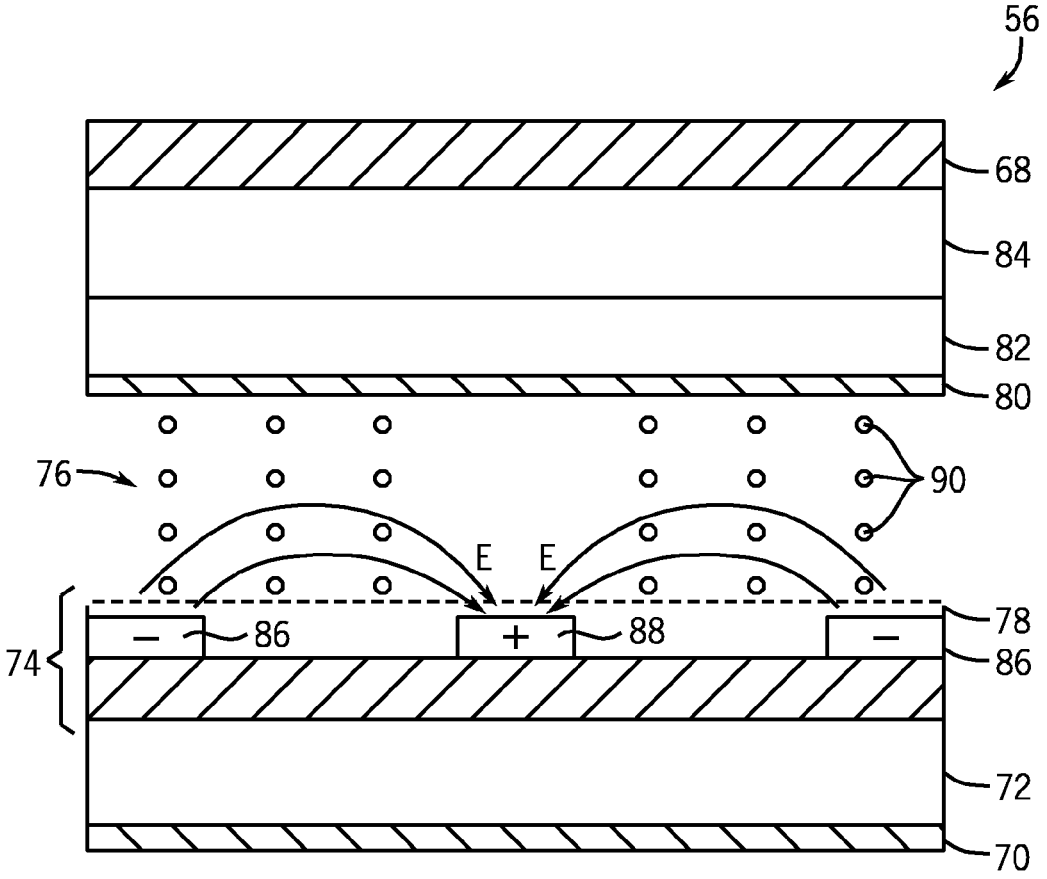
FIG. 5 is a cutaway cross-sectional side view of an LCD pixel having liquid crystal molecules oriented to inhibit light passage, in accordance with aspects of the present disclosure.

FIG. 5 is a cut-away cross-sectional side view of an LCD pixel having liquid crystal molecules oriented to inhibit light passage, in accordance with an embodiment of the present invention. The view of the pixel 56 in FIG. 5 includes upper polarizing layer 68, lower polarizing layer 70, lower substrate 72, TFT layer 74, liquid crystal layer 76, alignment layers 78 and 80, color filter 82, and upper substrate 84. It should be appreciated that embodiments of an LCD 32 may include some or all of the layers depicted in FIG. 5, or may include any additional layers.

The TFT layer 74 may include various conductive, non-conductive, and/or semiconductive layers and structures defining electrical devices and pathways for driving the operation of pixels 56. In the illustrated embodiment, the TFT layer 74 is shown in the context of an in-plane switching (IPS) LCD display device and includes pixel electrodes 86 and a common electrode 88.

The pixel electrodes 86 and the common electrode 88 may be made of a transparent conductive material, such as ITO or IZO The common electrode 88 generally spans the pixel 56, and may be connected to a common line (not shown) coupled to a common electrode driver discussed in more detail below. In the default orientation, liquid crystal molecules 90 are arranged to inhibit light passage through the LCD 32. Specifically, in the present embodiment, the polarization axis of the lower polarizing layer 70 may be oriented approximately 90 degrees relative to the upper polarizing layer 68. As will be appreciated, when light passes through a polarizing filter, the light becomes polarized along the polarization axis of the filter. In other words, the filter blocks the passage of light having any polarization axis other than the polarization axis of the filter. Therefore, light passing through the lower polarizing layer 70 may become polarized along the polarization axis of the lower polarizing layer 70. If each liquid crystal molecule 90 is oriented along substantially the same axis as the lower polarizing layer 70, the light may maintain its polarization axis while passing through the liquid crystal layer 76. Therefore, when the light impacts the upper polarizing layer 68, the polarization axis of the light is approximately 90 degrees offset from the polarization axis of the upper polarizing layer 68.

As previously discussed, a polarizing filter blocks the passage of light having a polarization axis offset from the polarization axis of the filter. Therefore, because the light is polarized 90 degrees relative to the polarization axis of the upper polarizing layer 68, substantially no light passes through the upper polarizing layer 68. Consequently, the default orientation of the liquid crystal molecules 90 substantially inhibits the passage of light through the LCD 32.

As illustrated in FIG. 5, liquid crystal molecules 90 may be oriented to facilitate light passage through the LCD 32. Specifically, when a driving voltage is applied to the pixel electrode 88, an electrical field is formed between the pixel electrodes 86 and common electrode 88. As discussed above, the electrical field (referred to herein by the reference label E) controls the orientation of liquid crystal molecules 90 within the liquid crystal layer 76, such that the orientation changes with respect to the default orientation, thereby allowing at least a portion of the light transmitted from a light source to be transmitted through the LCD 32. Thus, by modulating the electrical field E, the light provided by a light source and transmitted through the LCD 32 may be controlled. In this manner, image data sent along the data lines 60 and scanning lines 62 may be perceived by a user viewing the LCD 32 as an image.

In this configuration, LCD 32 may facilitate light passage when electrical field E is activated and inhibit light passage when electrical field E is deactivated. As will be appreciated, alternative orientations of the polarizing layers 68 and 70, as well as alternative configurations of the liquid crystal molecules 136 may be employed in further embodiments. Moreover, the electrical field E may cause the liquid crystal molecules 90 to rotate about any axes, such as the x-axis and/or the y-axis, in certain configurations.

Figure 6:
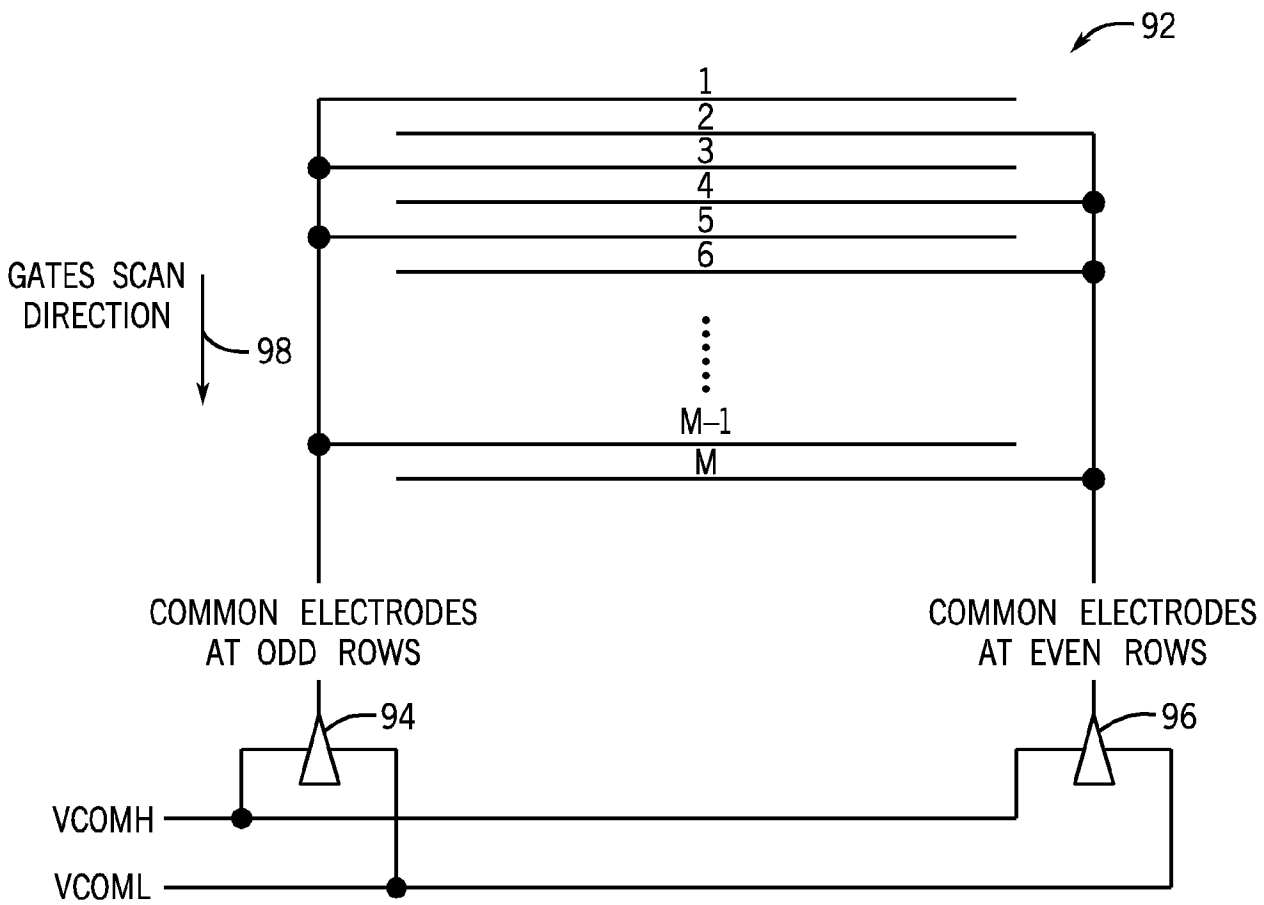
FIG. 6 is a schematic view of an LCD array having split common electrodes for even-numbered and odd-numbered lines in accordance with an embodiment of the present invention.

In certain embodiments, split common electrodes may be provided for various configurations of pixels, e.g., multiple lines (e.g., rows) of pixels may share a common electrode. One such embodiment may include a group of odd-numbered lines connected to a first common electrode and a group of even-numbered lines connected to a second common electrode, such that there are two common electrodes connected to the common voltages (also referred as "split Vcom"). FIG. 6 depicts a schematic of an embodiment of an LCD array 92 having M-numbered of lines, with odd numbered lines (e.g., lines 1, 3, 5, etc.) coupled to common electrode 94 and even-numbered lines coupled to a common electrode 96. Each common electrode 94 and 96 is shown coupled to a high common voltage (VCOMH) and a low common voltage (VCOML). As described above, in an IPS panel, the common electrodes 94 and 96 may be located in the same plane, e.g., in or on the same plane of glass.

In such an embodiment, a frame inversion of the entire array 92 may introduce visual artifacts due to the line-by-line redraw of the frame inversion. For example, a typical frame inversion switches polarity of the two common electrodes once per frame. The lines (and pixels) of the array 92 maintain one electric potential for the duration of the frame. For a typical refresh of the array, e.g., 60 Hz (16.7 ms), the frame inversion holds the two common electrodes at one polarity as the lines of the array are scanned (redrawn) from line 1 to line M, as indicated by arrow 98. However, this frame refresh may result in a visible brightness gradient or other visual artifacts as the scanning moves from the top lines of the array 92 to the bottom lines of the array 92 during the refresh. This gradient is referred to as luminance declination.

Figure 7B:
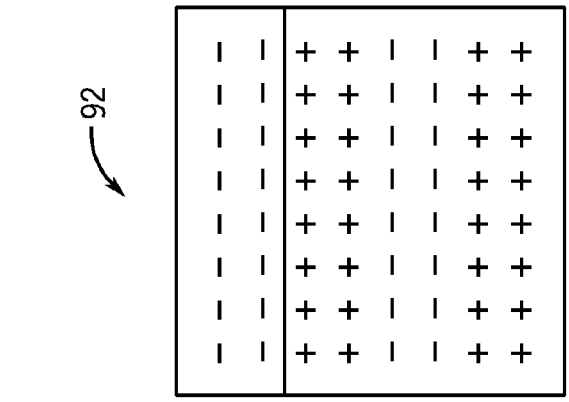
FIGS. 7A and 7B depict a staggered 2-line inversion for the array of FIG. 6 in accordance with an embodiment of the present invention.
Figure 7A:
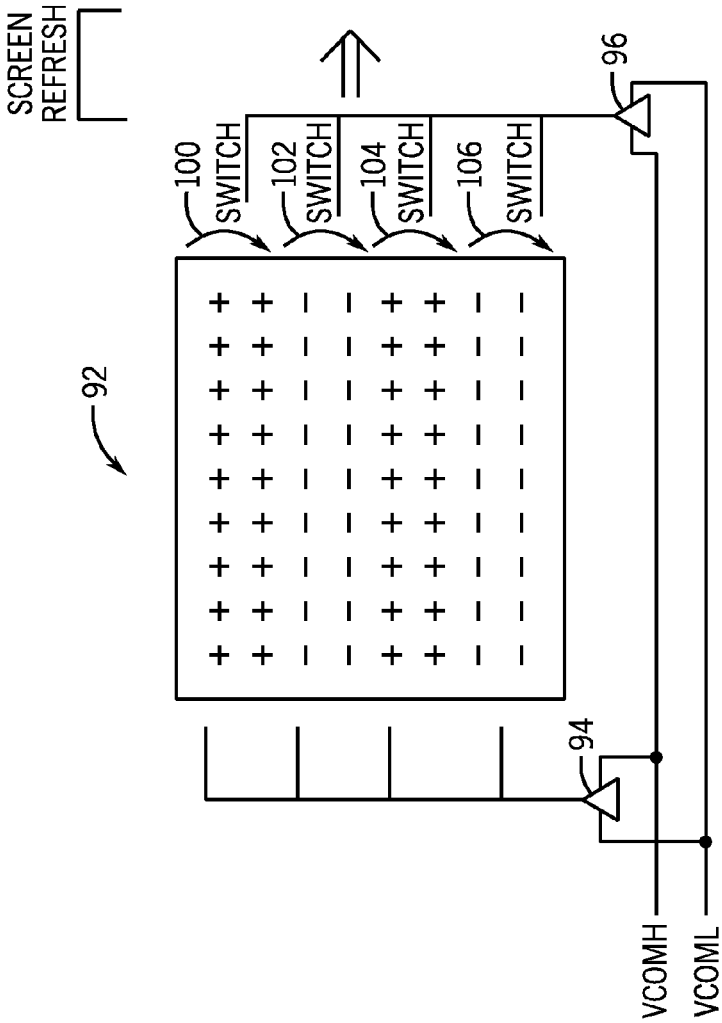

FIGS. 7A and 7B depict a staggered 2-line inversion applied to the array 92 in accordance with an embodiment of the present invention. The staggered 2-line inversion described in FIGS. 7A and 7B, and the 1-line inversion and N-line inversion described, may be implemented by reprogramming and/or reconfiguring the driver circuits of an LCD panel. Thus, these techniques may be applied to an LCD panel without redesigning or adding hardware components. In other embodiments, implementation of the staggered inversion discussed herein may be fully or partially supported by additional or modified hardware of LCD panel drivers. Some embodiments may include instructions (e.g., code) stored on a tangible machine-readable medium to implement the inversion techniques discussed below.

As described below, the 2-line inversion redraws 2 lines for each polarity switch, e.g., one even line and one odd line are switched to the same polarity, such that the polarity is switched for every 2 lines in a single frame instead of frame-by-frame as in the frame inversion described above. Thus, during the 2-line inversion of the split common electrode array 92, the polarity of the common electrodes is switched at a rate equal to half the number of lines multiplied by the refresh rate. For example, for a 320 line array and a refresh rate of 60 Hz, the frame refresh described above switches the polarity of the common electrodes every frame, e.g., every 16.7 ms for a 60 Hz refresh. However, for a 2-line inversion, to maintain a 60 Hz refresh rate, polarity is switched for each "2-line" pair of the 2-line inversion during a single frame. Thus, for 160 2-line pairs (half of the 320 line array of the present example), the polarity of the common electrodes is switched a number equal to 60 (the refresh rate) multiplied by 160 (half the number of lines) in one frame to ensure that the entire array 92 is refreshed at 60 Hz. The above example may be applied to an array having any number of lines and operating at any refresh rate.

FIGS. 7A and 7B depict the polarity of two frames of a refresh of the array 92, with FIG. 7A depicting the polarity of lines for a first frame of the array 92 and FIG. 7B depicting the polarity of lines of the second frame. As described above and as shown in FIGS. 7A and 7B, the odd-numbered lines are coupled to odd-numbered line common electrode 94 and the even-numbered lines are coupled to even-numbered line common electrode 96.

During the first frame, each line of each 2-line pair of the array 92 may have the same polarity. Thus, lines 1 and 2 may have a positive polarity, lines 3 and 4 may have a negative polarity, and so on as shown in FIG. 7A. During a refresh, the polarity is switched for each 2-line pair, scanning the entire array 92, until each 2-line pair is switched (redrawn), as indicated by arrows 100 through 106. For example, as shown in FIG. 7B, the first 2-line inversion 100 may result in a switch of lines 1 and 2 from a positive polarity to a negative polarity. After the first 2-line inversion, the 2-line pair, e.g., lines 3 and 4 may be switched from a negative polarity to a positive polarity. In this manner, the polarity of each 2-line pair is inverted down the array 92 until the entire array is inverted (refreshed).

Figures 8A, 8B:
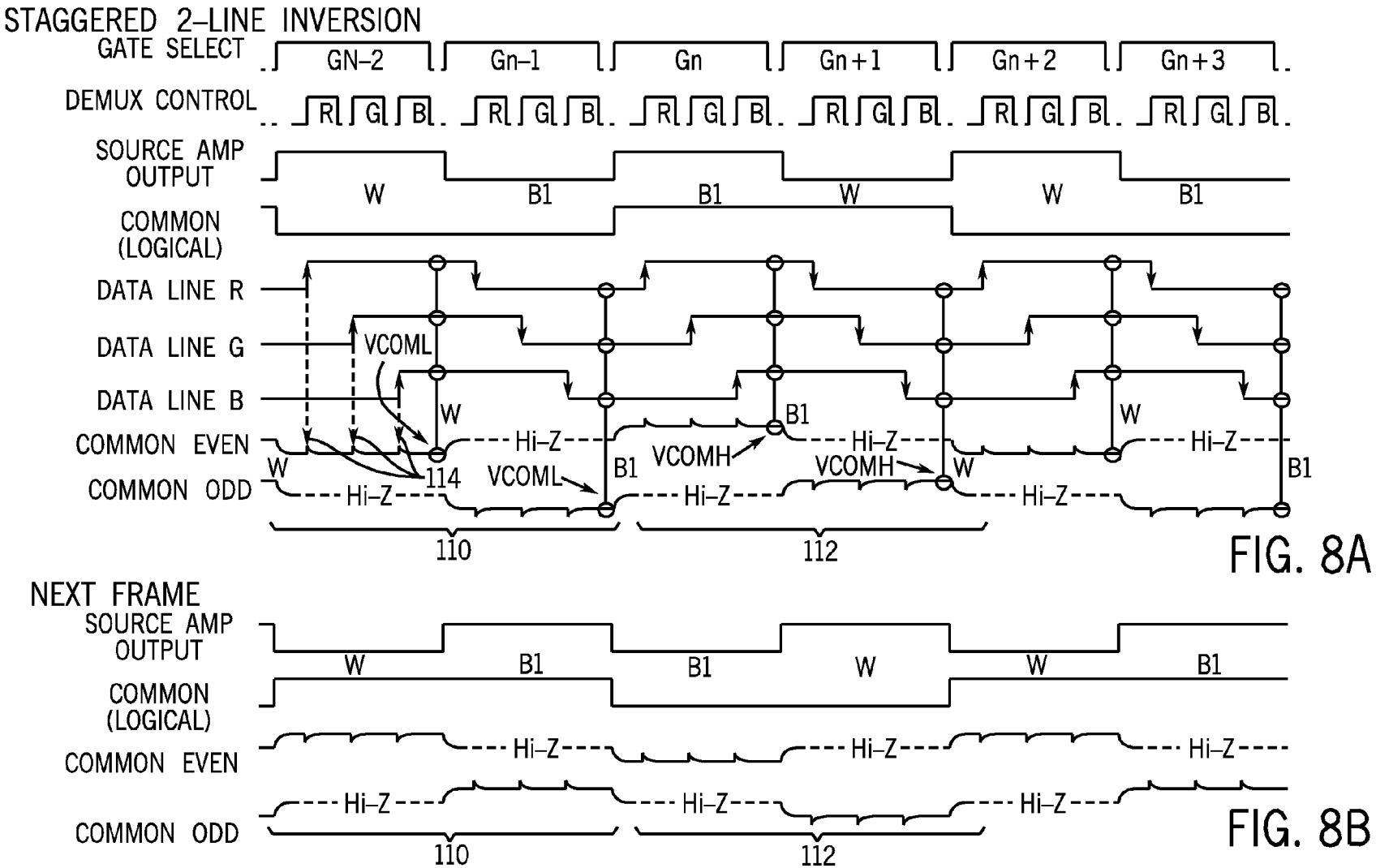
FIGS. 8A and 8B depict a signal diagram for the staggered 2-line inversion having a high impedance power reduction for the array of FIG. 6 in accordance with an embodiment of the present invention.

As will be appreciated, increasing the switching frequency of the common voltages to switch polarity for each 2-line pair for a 60 Hz refresh may increase power consumption of the array 92, as compared to a frame refresh in which the polarity is switched once for each frame. FIGS. 8A and 8B depict a signal diagram of a staggered 2-line inversion with a high-impedance power reduction technique in accordance with an embodiment of the present invention. As discussed further below, the common electrode for the offset line of each 2-line inversion described above may be switched into a third state, i.e., a high impedance (Hi-Z) state, to reduce or eliminate current draw from the common electrode and corresponding driver for the offset line, thereby reducing the overall power draw of the 2-line inversion. This power reduction may compensate for the power increase resulting from the increased switching frequency. Thus, during the 2-line inversion, the common electrodes 94 and 96 may switch among a low common voltage, a high common voltage, and a high-impedance state.

FIGS. 8A and 8B depict the following signals: gate select signal, demux control signal (for the red (R), green (G), and blue (B) data signals), source amplifier voltage signal (for the data lines), common (logical) analog voltage, data line R, data line G, data line B, the common electrode voltage signal (Common Even) for the even-numbered lines and the common electrode voltage signal (Common Odd) for the odd numbered lines. FIGS. 8A and 8B depict a first frame and a second frame respectively during refresh of an image for a "worst case," wherein the image is a mid gray image having alternating pairs of white (W) lines and black (Bl) lines that results in the largest power consumption, as indicated by W and BI portions of the signals depicted in FIGS. 8A and 8B. FIGS. 8A and 8B depict portions of the signals for inversion of lines n−2 through n+3 with each line being active as indicated by the "high" gate select signal provided for gates Gn−2, Gn−1, Gn, Gn+1, Gn+2, and Gn+3.

A first 2-line pair inversion 110 and a second 2-line pair inversion 112 highlighted in FIGS. 8A and 8B will be discussed. Beginning with line n−2 (an even-numbered W line), the gate select signal is provided high to turn on the transistors coupled to that line. The even-numbered lines' common electrode may be driven to the low common voltage (as shown by Common Even at VCOML) such that there is a maximized voltage differential between the data line and the common electrode (resulting in the pixels of the line allowing full light to pass through). The RGB data lines (Data Line R, Data Line G, and Data Line B) are switched to the appropriate voltages to provide a white pixel. Each switch of the RGB data lines is reflected by the signal peaks 114 shown in the Common Even signal.

To reduce current draw of the offset line, e.g., the odd-numbered line of the 2-line inversion, the common electrode of the odd-numbered lines may be switched to a high-impedance (Hi-Z) state, reducing or eliminating any current draw by the odd-numbered lines' common electrode driver. As shown in FIG. 8A, the odd-numbered lines' common electrode signal (Common Odd) does not include any peaks or troughs during the switch of the RGB data lines, as the high impedance results in minimal or no current draw by the odd-numbered line's common electrode driver. Thus, FIG. 8A depicts a corresponding portion of the Common Odd signal as dashed portion Hi-Z.

Turning to the second line of the 2-line inversion 110 (line n−1), the second line, e.g., odd-numbered line, of the 2-line inversion is redrawn to black (Bl). The common (logical) voltage remains low, as it switches for every 2-lines in the 2-line inversion. The odd-numbered lines' common electrode is driven to the low common voltage (VCOML), as shown the Common Odd signal, switching from the high impedance (Hi-z) state. Because the even-numbered line of this 2-line inversion switch is "idle" and has already been redrawn, the even-numbered lines' common electrode is switched to the high-impedance (Hi-Z) state, as shown by dashed Hi-Z portion of the Common Even signal. Again, each switch of the RGB data lines results in a current draw on the currently drawn odd-numbered line, as shown by troughs 116 in the Common Odd signal. In contrast, the high-impedance state of the even-numbered lines' common electrode reduces or eliminates any current draw that could result from the voltage differential between the RGB data lines and the even-numbered lines' common electrode.

Turning now to the next 2-line inversion 112, the common (logical) voltage signal is switched from low voltage to high voltage. Line n is a black(B) even-numbered line and is activated by driving the gate select voltage high as shown by the Gn portion of the gate select signal. The even-numbered lines' common electrode is switched to the high common voltage (VCOMH) as shown by the Common Even signal, minimizing the voltage differential to achieve a black (Bl) line. For the offset or "idle" line of the 2-line inversion, the odd-numbered lines' common electrode, is switched to the high-impedance state (Hi-Z) state, as indicated by dashed Hi-Z portion of the Common Odd signal.

The second line (n+1) of the 2-line inversion 112 is a white (W) odd-numbered line. To produce the white pixels, the odd-numbered lines' common electrode is switched to the high common voltage, as shown by the Common Odd signal, resulting in a voltage differential. In contrast, the even-numbered lines' common electrode is switched to the high-impedance (Hi-Z) state. Again, this high impedance state minimizes or reduces any current draw by the even-numbered lines' common electrode driver from the data lines. In this manner, by switching each offset line's electrode to a high-impedance (Hi-Z) state between the low common voltage and the high common voltage during a 2-line inversion, the driver for the offset line of a 2-line inversion may draw no current, reducing the overall power usage of the 2-line inversion.

The next frame is depicted in FIG. 8B and shows the switching of polarity for the lines previously described and illustrated in FIG. 8A. As seen in FIG. 8B, the next frame includes the same switching techniques for the even-numbered lines' common electrode and the odd-numbered lines common electrode, using the reversed polarity than the first frame. Thus, both the Common Even and Common Odd signals alternate among high common voltage, low common voltage, and a high impedance (Hi-Z) state.

Figure 9A:
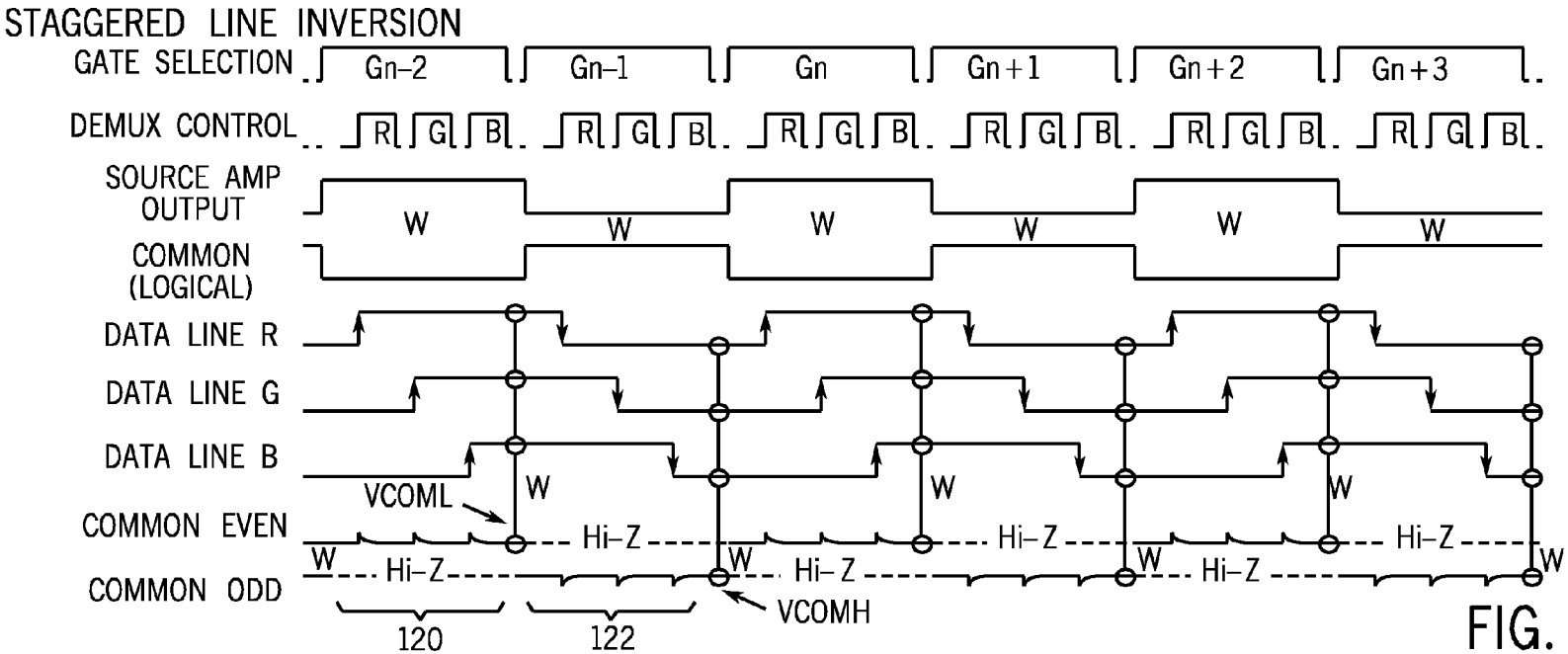
FIGS. 9A and 9B depict a signal diagram for a staggered 1-line inversion having high impedance power reduction for the array of FIG. 6 in accordance with an embodiment of the present invention.
Figure 9B:
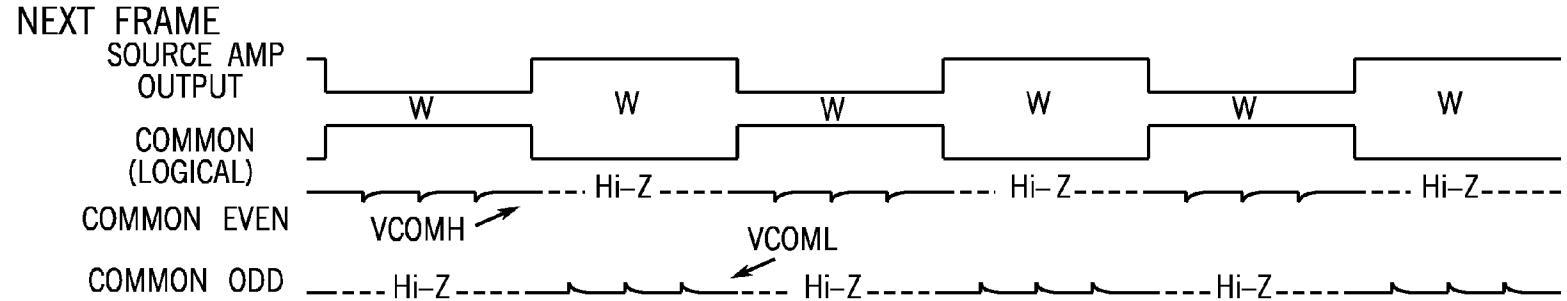

In some embodiments, another inversion technique may include a 1-line staggered inversion, as shown in the signal diagrams depicted in FIGS. 9A and 9B. The 1-line staggered inversion may use comparatively less power than the frame inversion, but may be less suitable for reducing luminous declination as compared to the 2-line staggered inversion.

FIGS. 9A and 9B depict signal diagrams for a first and second frame respectively of a 1-line staggered inversion for the split common electrode LCD array 92 described above. Again, FIGS. 9A and 9B depict a "worst case" wherein the image is a white image having white (W) lines that results in the largest power consumption for the staggered 1-line inversion. FIGS. 9A and 9B depict the following signals: gate select signal, demux control signal (for the red (R), green (G), and blue (B) data signals), source amplifier voltage signal (for the data lines), common (logical) analog voltage, data line R, data line G, data line B, the common electrode voltage signal (Common Even) for the even-numbered lines and the common electrode voltage signal (Common Odd) for the odd numbered lines.

As shown in FIG. 9A and 9B, the common (logical) voltage switches for every 1 line, as each line is inverted during a frame. Instead of each common electrode (corresponding to Common Odd and Common Even signals) switching among a low common voltage, high impedance, and high common voltage, each common electrode only switches between a high or low common voltage and high impedance, as there is no corresponding offset or "idle" line during the staggered 1-line inversion. For example, as shown in FIG. 9A, the even-numbered lines common electrode (Common Even signal) switches between low common voltage and the high impedance state for 1-line inversions 120 and 122. The odd-numbered lines common electrode (Common Odd signal) switches between high common voltage and the high impedance state. As noted above, the common (logical) voltage switches for each line; thus, each common electrode (Common Even or Common Odd) is only driven to the corresponding high common voltage or low common voltage to achieve white (W) pixels for that line (in combination with the RGB data lines). By switching the even-numbered lines' common electrode to a high-impedance state during inversion of the odd-numbered lines, any current draw by the even-numbered lines' common electrode driver may be reduced or eliminated, as described above. Similarly, by switching the odd-numbered lines' common electrode to a high-impedance state during inversion of the even-numbered lines, any current draw by the odd-numbered lines' common electrode driver may be reduced or eliminated.

FIG. 9B depicts the next frame during the 1-line inversion. As seen in FIG. 9B, the even-numbered lines' common electrode (Common Even) switches between a high common voltage (to achieve the opposite polarity of the lines than in the first frame) and the high impedance (Hi-Z) state. Similarly, the odd-numbered lines' common electrode (Common Odd) switches between a low common voltage (to achieve the opposite polarity of the lines than in the first frame) and the high-impedance (Hi-Z) state.

Figure 10:
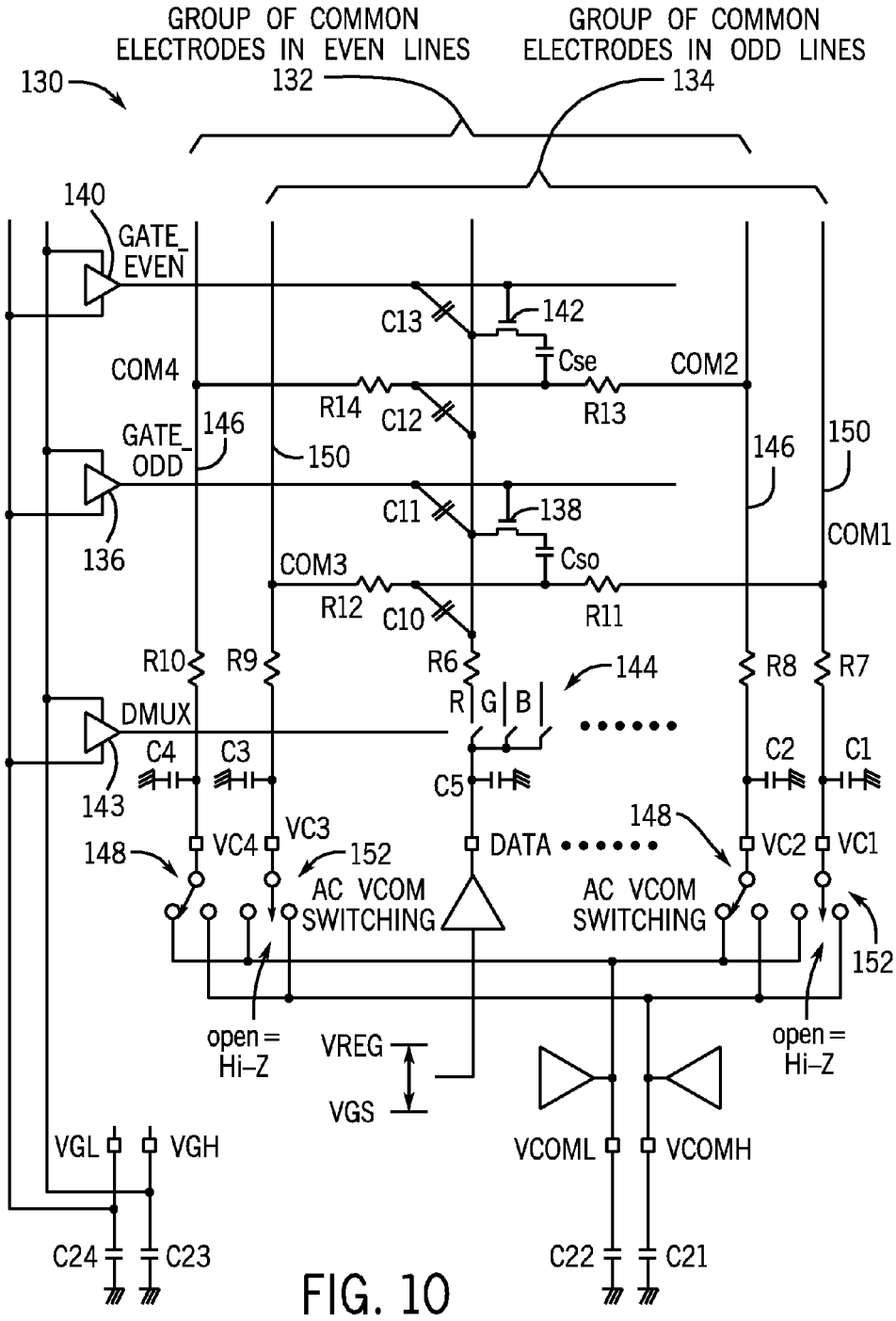
FIGS. 10 and 11 depict a circuit diagram of a driver illustrating the high impedance power reduction techniques in accordance with an embodiment of the present invention.

FIG. 10 depicts an embodiment of a driver circuit 130 that may implement the high impedance power reduction during the 1-line inversion or 2-line inversion described above, or the staggered N-line inversion described below. As described in more detail below, the high impedance power reduction may be implemented in such an embodiment by reprogramming and/or reconfiguring the actions of various switches of the driver circuit 130 to switch a driver to a third high impedance state. In other embodiments, any switching device capable of enabling the high impedance state, such as through programming or configuring the device, may be used. Some embodiments may include instructions (e.g., code) stored on a tangible machine-readable medium to implement the switching discussed below.

As shown in FIG. 10, the driver circuit 130 includes a driver circuit 132 for the even-numbered lines' common electrode and driver circuit 134 for the odd-numbered lines common electrode. The odd-numbered lines' common electrode driver 134 may include odd-numbered lines gate drivers 136 for driving (switching) transistors 138 for the pixels of the odd-numbered lines. Similarly, the even-numbered lines' common electrode driver 132 may include even-numbered lines gate driver 140 for driving (switching) transistors 142 for the pixels of the even-numbered lines. Each gate driver 140 and 136 may be coupled to a high gate voltage (VGH) and a low gate voltage (VGL). The RGB data signal is provided by a demultiplexer 143 that demuxes output from the data line into individual RGB data lines 144 (as illustrated above in the signal diagrams of FIGS. 8 an 9).

To provide the switching described above for the common electrodes, the common electrode drivers 132 and 134 may be switchably coupled to a low common voltage (VCOML) and high common voltage (VCOMH). As shown in FIG. 10, the driver 132 for the even-numbered lines is coupled to VCOML and VCOMH via lines 146 and switches 148. Similarly, the driver 134 for the odd-numbered lines may be coupled to VCOML and VCOMH via lines 150 and switches 152. Thus, to switch between VCOML and VCOMH for the even-numbered lines' common electrode, switches 148 may be switched between VCOML and VCOMH. To switch between VCOML and VCOMH for the odd-numbered lines common electrode, switches 152 may be switched between VCOML and VCOMH. In an embodiment, the switches 148 and 152 may be NMOS transistors, PMOS transistors, or any combinations thereof.

As discussed above and as shown in FIG. 10, the power consumption during inversion of the even-numbered lines may be reduced by switching the odd-numbered lines' common electrode driver 134 to a high-impedance state. The configuration depicted in FIG. 10 corresponds to the black (B) line of the 2-line inversion 112 depicted in FIG. 8A. To achieve the high-impedance state, the switches 152 coupling the odd-numbered lines' common electrodes to the low common voltage and high common voltage may be switched to a third state, as shown in FIG. 10. The switches 152 are switched to an third state, such that the switches are not connected to the low common voltage or the high common voltage (also referred to as "floating" the driver 134, as it is not coupled to any voltage source). In this manner, the high-impedance of the odd-numbered lines' common electrode driver 134 results in no current flow across capacitor C10, reducing or eliminating the current draw of the driver 134. The common electrode driver 132 for the even-numbered lines is coupled to low common voltage (VCOML) via switches 148, driving the even-numbered lines' common electrode to VCOML. The differential voltage (Vd) between the data line and the common electrode lines 146 results in current flow across capacitor 012.

Figure 11:
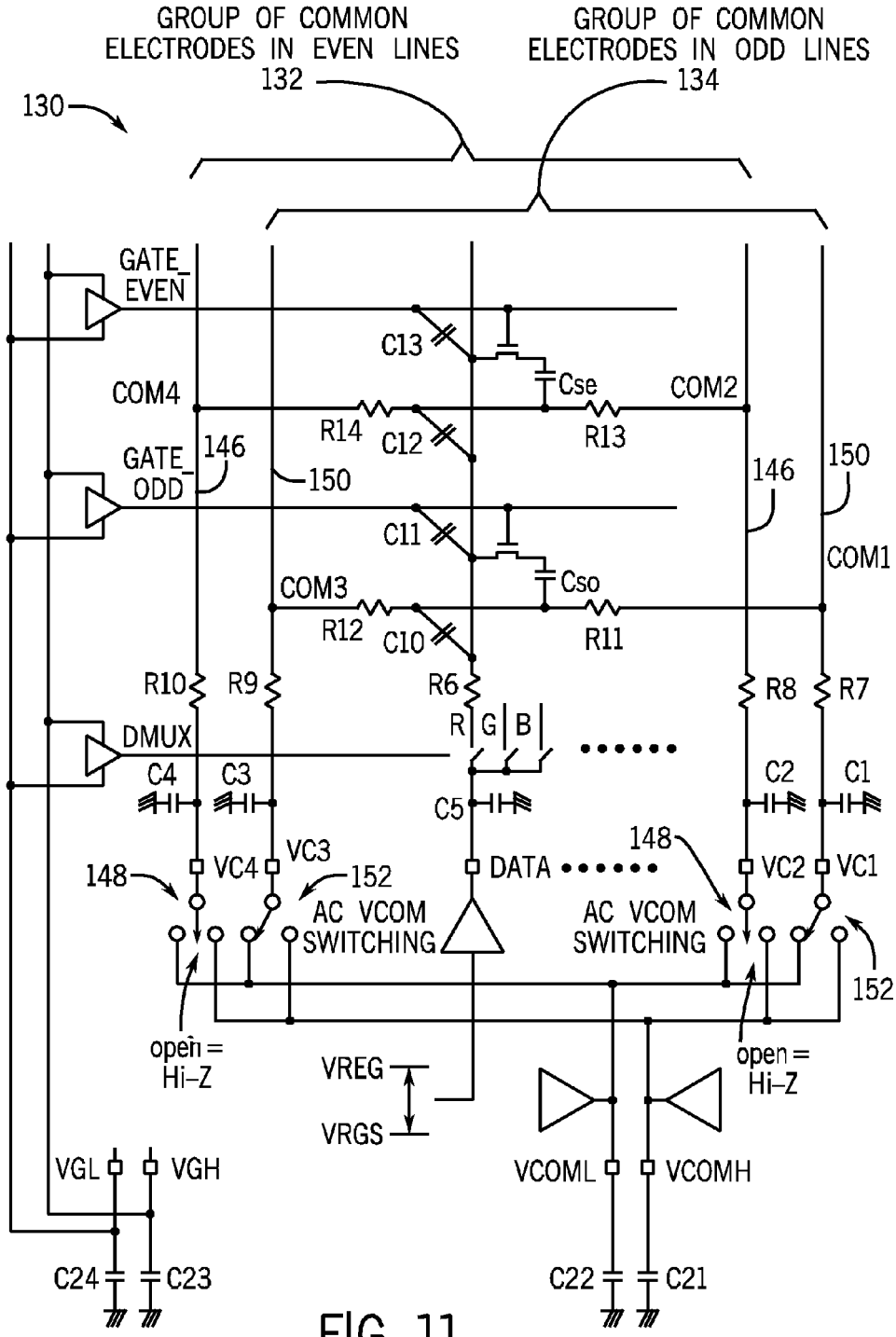

FIG. 11 depicts a diagram of the driver circuit 130 during the inversion of the odd-numbered line of the 2-line inversion 112 described above. FIG. 11 corresponds to the black (B) line depicted in staggered 2-line inversion 112 depicted in FIG. 9A. As shown, in FIG. 11, the driver circuit 134 for the odd-numbered lines is coupled to the VCOML via switches 152, driving the odd-numbered lines' common electrode to the VCOML. In contrast, switches 148 of the even-numbered lines' common electrode driver 132 are switched to a third state, disconnecting the even-numbered lines' common electrode driver 132 from the low common voltage and high common voltage (i.e., floating the even-numbered lines' common electrode driver 132). Thus, the even-numbered lines' common electrode driver is switched to the high-impedance (Hi-Z) state. The voltage differential (Vd) between the data line and the common electrode lines 150 for the odd-numbered lines' driver 134 results in current flow through capacitor C10. In contrast, the common electrodes lines 146 for the even numbered lines' driver 132 is set to the high impedance state, resulting in no current draw across capacitor C12.

Figure 12:
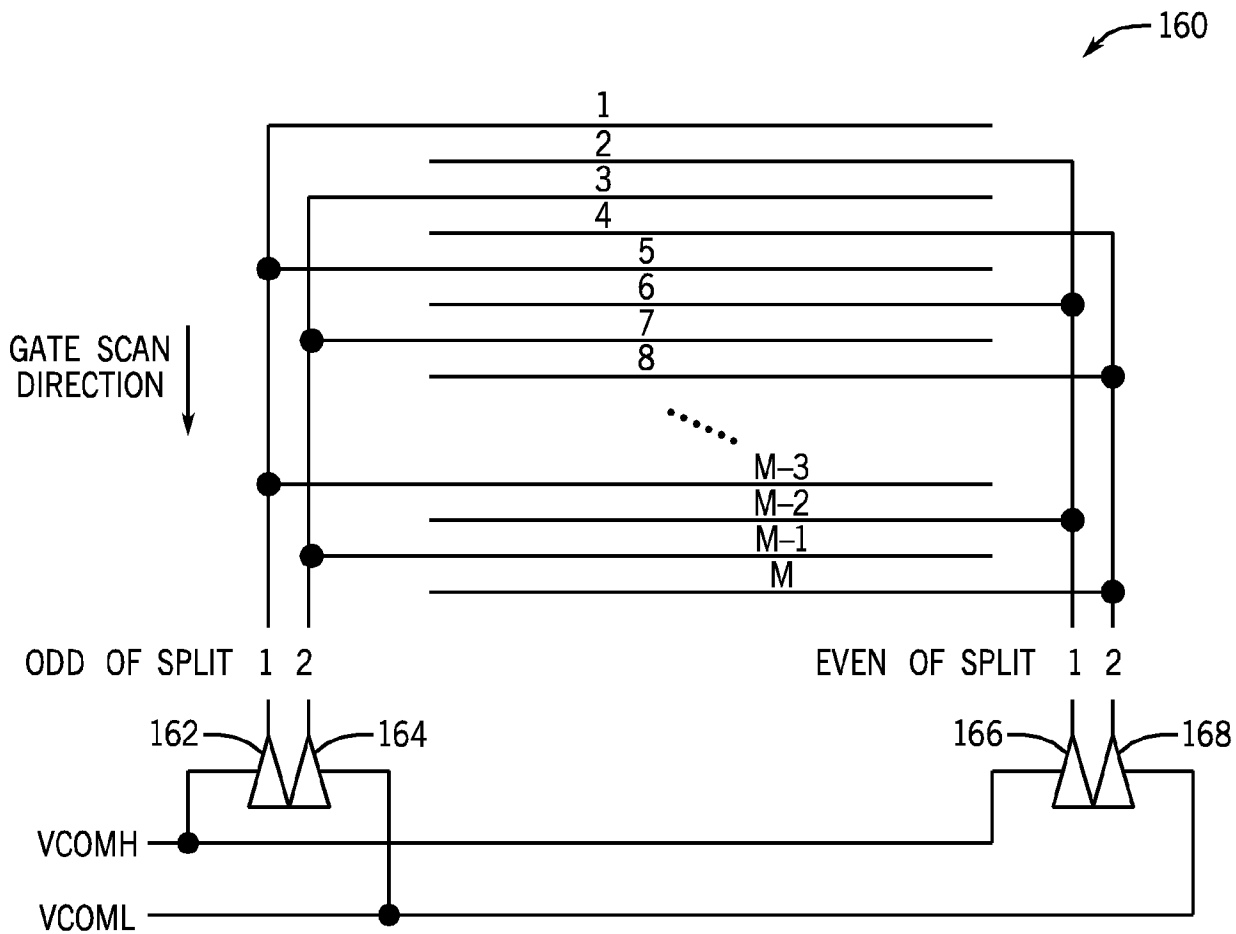
FIG. 12 depicts a schematic view of an array having N-number of split common electrodes in accordance with an embodiment of the present invention.

In other embodiments, there may be any number N of logically different common electrodes coupled to the lines of a pixel array of the LCD 32. FIG. 12 is a schematic diagram of a pixel array 160 with M number of lines, having N=4 number of common electrodes in accordance with another embodiment of the present invention. As shown in FIG. 12, there are N=4 common electrodes, 162, 164, 166, and 168. Each common electrode may be coupled to M/N number of lines. For example, for a pixel array having M=320 number of lines and N=4 number of common electrodes, each common electrode may be coupled to 320/4 (M/N)=80 lines. In such an embodiment, each common electrode is coupled to every fourth line. Thus, as shown in FIG. 12, common electrode 162 is coupled to lines 1, 5, etc. Common electrode 164 is coupled to lines 2, 6, etc., common electrode 166 is coupled to lines 3, 7 etc., and so on. The increase in N (the increase in logically split common electrodes) may reduce power consumption during the line inversion techniques discussed above while more effectively reducing visual artifacts such as luminance declination.

Figure 13:
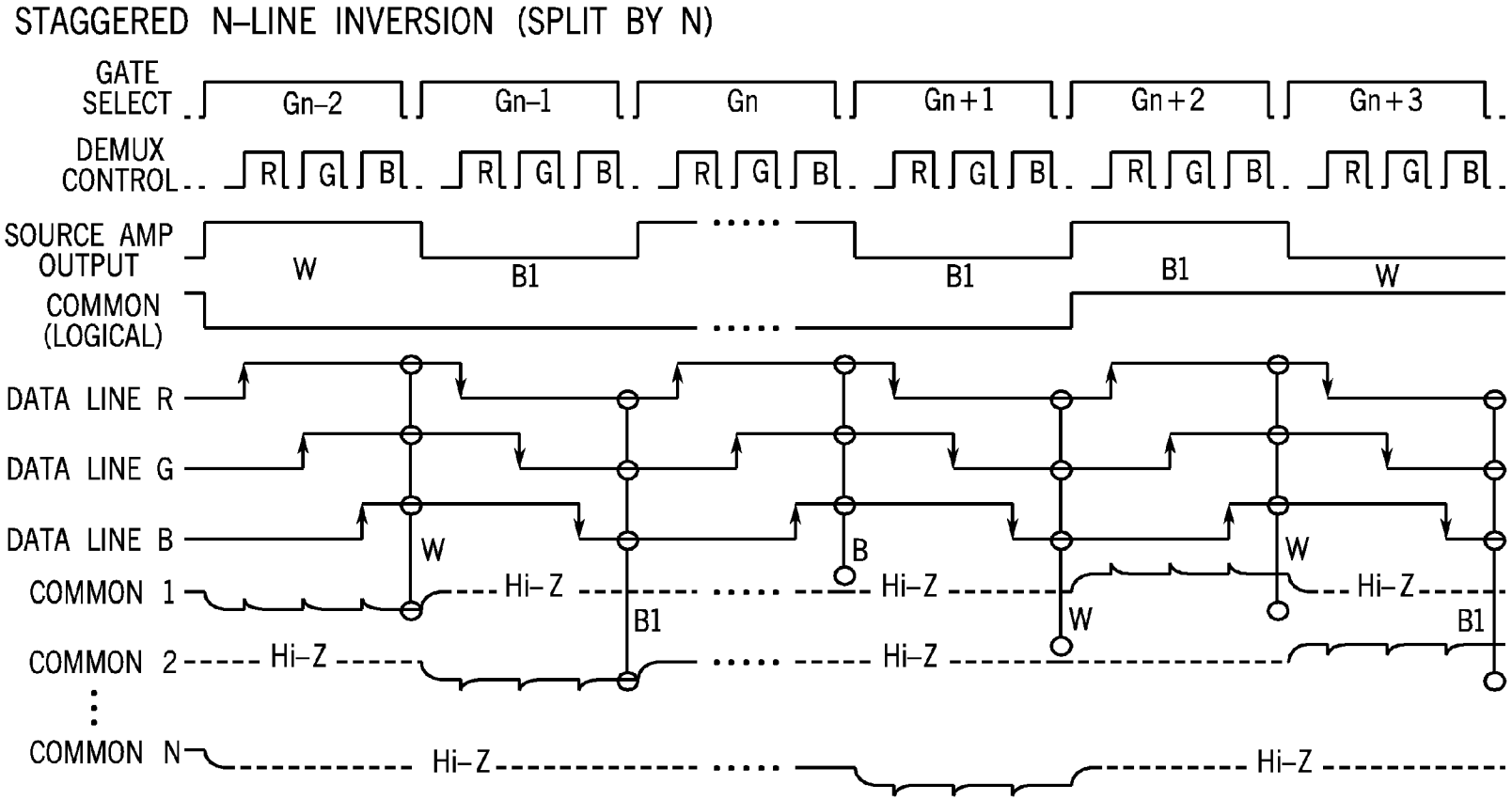
FIG. 13 depicts a staggered N-line inversion having high impedance power reduction for the array of FIG. 12 in accordance with an embodiment of the present invention.

FIG. 13 is a signal diagram of a staggered N-line inversion in accordance with another embodiment of the present invention. In an embodiment having N number of logically split electrodes such as illustrated above in FIG. 12, the staggered inversion may be split by N number of lines. Thus, the common (logical) voltage switches with N-line frequency. For example, the embodiment discussed above in FIG. 8 depicts a 2-line staggered inversion in which the common (logical) voltage switches for every two (N=2) lines during the refresh, such that the switching frequency is equal to the refresh rate times M/2 (M/N). As shown in FIG. 13, for any given N number of common electrodes, the common (logical) voltage switches at a frequency equal to the refresh rate times (M/N). As will be appreciated, for each "idle" line during a staggered N-line inversion, the corresponding N number of common electrodes and drivers may be switched to a high-impedance (Hi-Z) state. For example, as shown in FIG. 13, for inversion of lines coupled to a first common electrode, the first common electrode (Common 1 signal) may be switched to the low common voltage, while a second common electrode (Common 2 signal) may be switched to the high impedance (Hi-Z) state as those lines coupled to the second common electrode are "idle" during inversion of the lines coupled to the first common electrode. Further, additional common electrodes (up to common electrode N depicted by Common N signal) may be switched to a high impedance (Hi-Z), as shown by the common N signal.

Figure 14:
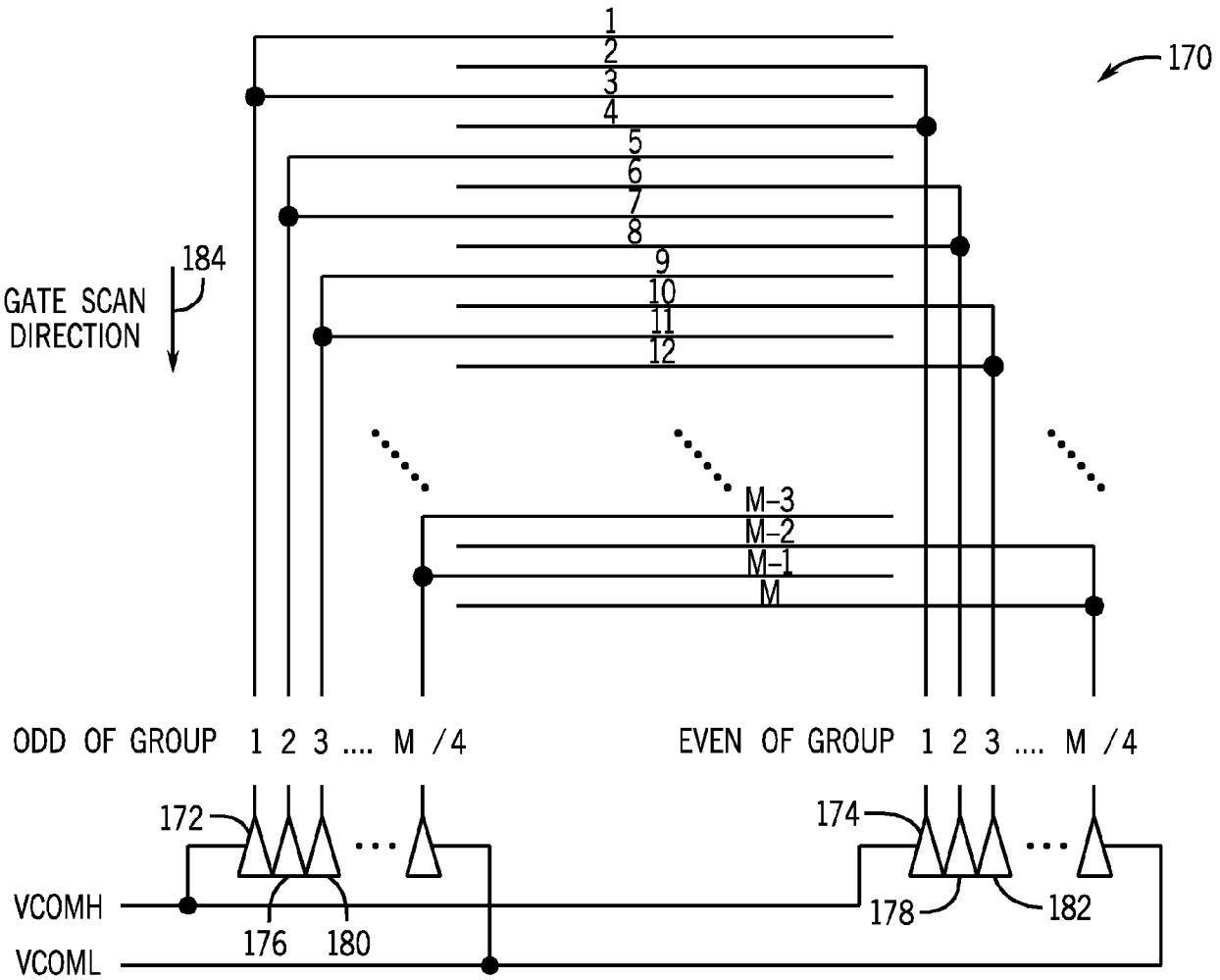
FIG. 14 depicts a schematic view of an array having grouped split common electrodes in accordance with an embodiment of the present invention.

In other embodiments having N number of logically split common electrodes, the lines of an array may be coupled to a split common electrode by groups of L number of lines. FIG. 14 is a schematic of a pixel array 170 having M number of lines, N=2 number of split common electrodes and groups of L=4 number of lines in accordance with another embodiment of the present invention. As shown in FIG. 14, there are M/L (M/4) number of groups divided among N=2 common electrodes 172, 174, 176, 178, 180, 182, and so on. For example, a first group may include lines 1, 2, 3, and 4 divided among 2 common electrodes 172 and 174. A second group may include lines 5, 6, 7, and 8 divided between 2 common electrodes 176 and 178, a third group may include lines 9, 10, 11 and 12 divided between 2 common electrodes 180 and 182 and so on. In such an embodiment, the split common electrodes may be grouped in the direction of the display scan (indicated by arrow 184). Once the display scan is complete, a scanned line may be maintained in a high impedance (Hi-Z) state as described above to reduce power consumption. Thus, when a group is "passed' during a scan, the common electrode driver for the group may be switched to the high impedance (Hi-Z) state. Such an embodiment may use L times 2 number of routing wires (L×2) between the array and the drivers. The number of groups (i.e., number of lines L in a group) may be selected to achieve a desired balance between the number of routing wires and the desired power consumption.

Figure 15:
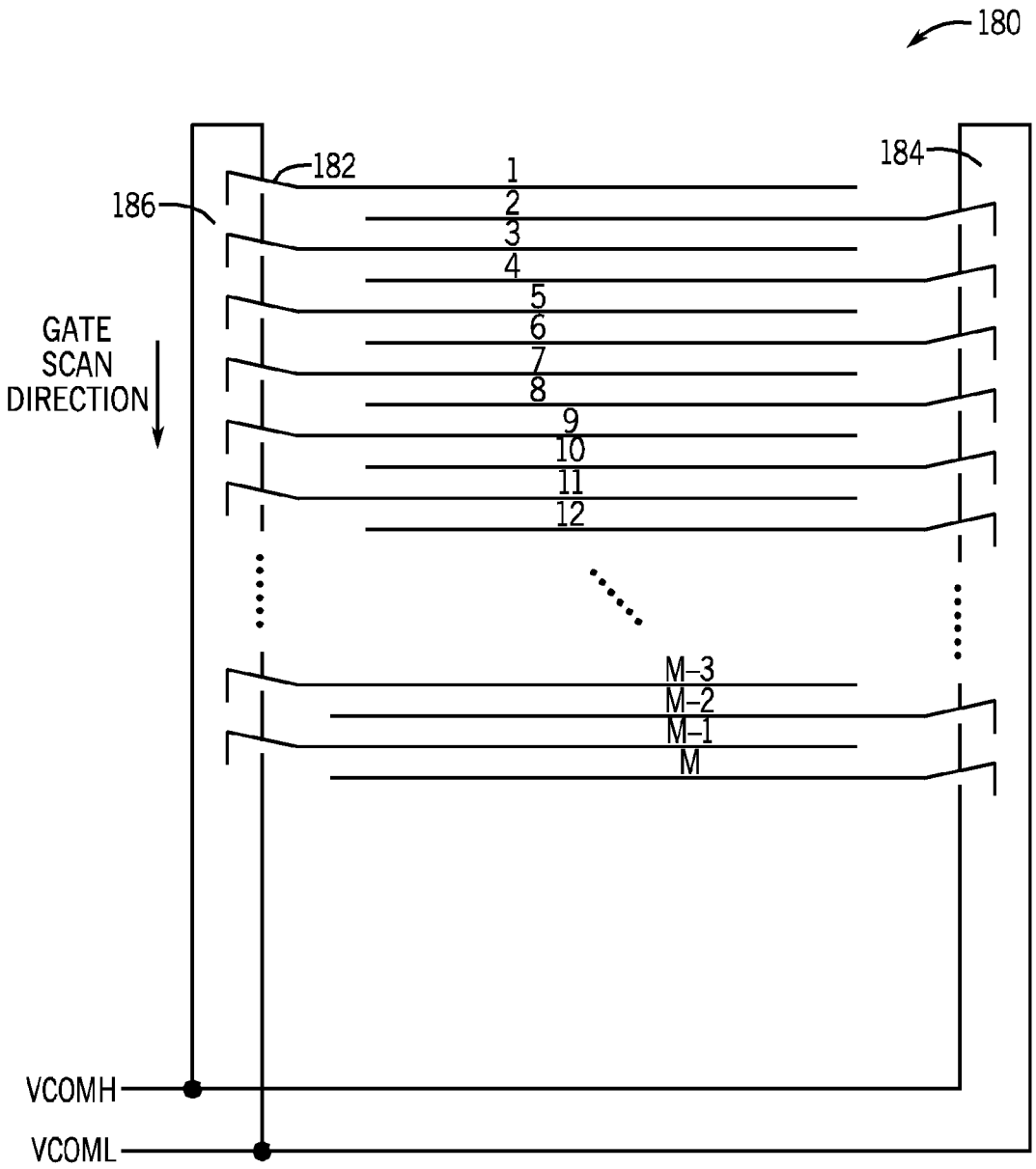
FIG. 15 depicts a schematic view of an array having individually split common electrodes in accordance with an embodiment of the present invention.

In yet other embodiments, each line of an array may be coupled to an individual electrode, such that the number of groups is equal to the number of lines of the pixel array. FIG. 15 depicts an embodiment of a pixel array 180 having L=1, M number of groups, and N=2 number of logically split electrodes. Each line depicted in FIG. 15 may be coupled to a common electrode. Thus, line 1 (e.g., a first group having L=1 number of lines) is coupled to common electrode 182, line 2 (e.g., a second group having 1 line) is coupled to common electrode 184, line 3 (e.g. a third group) is coupled to common electrode 186, and so on.

Figure 16:
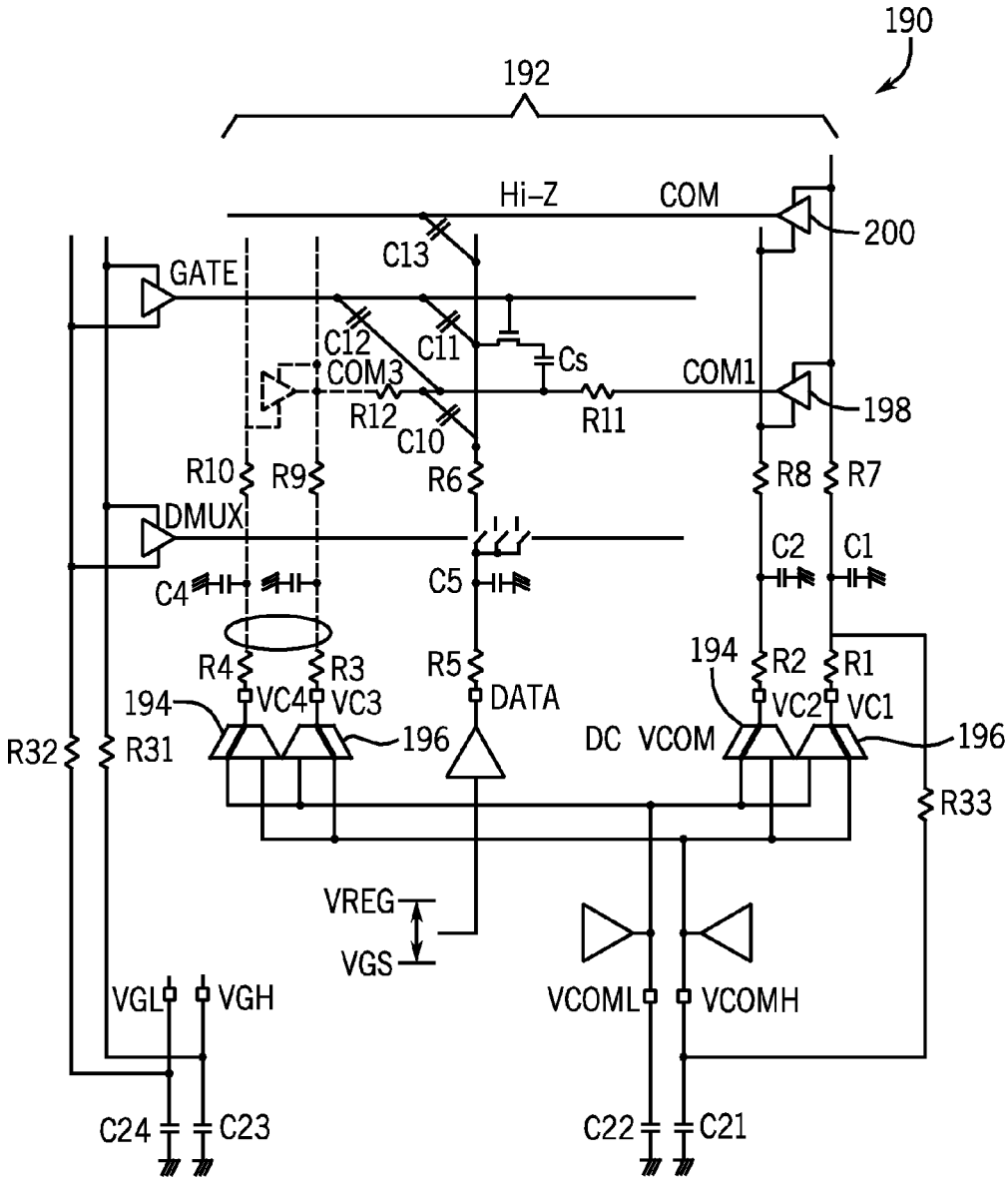
FIG. 16 depicts a circuit diagram of a driver of the array of FIG. 15, illustrating the high impedance power reduction techniques in accordance with an embodiment of the present invention.

FIG. 16 depicts a circuit diagram of a driver circuit 190 for the pixel array 180 described above in FIG. 15 in accordance with another embodiment of the present invention. As shown in FIG. 15, the driver circuit 190 may include a common electrode driver 192 switchably coupled to the low common voltage (VCOML) and high common voltage (VCOMH) via switches 194 and 196. As described above, these switches enable switching of the common electrode to a high impedance state by disconnecting the switches from VCOML and VCOMH and floating the driver. Further, in some embodiments the driver circuit 190 may include CMOS buffers 198 and 200. CMOS buffers 198 and 200 may switch between the high rail and low rail of the driver coupled to VCOML and VCOMH respectively. Additionally, CMOS buffer 200 may include a high impedance state, such that switching to the high impedance state results in no current draw across capacitor Cb and reduces power consumption of the additional buffers 198 and 200. For example, as shown in FIG. 16, the CMOS buffer 200 may be switched to a high-impedance state during "idle" of the line coupled to the driver.

It should be appreciated that any or all of the techniques discussed above may be combined with other power saving techniques, such as charge recycling. Further, any of the line inversion or split common electrode embodiments may be selected in any combination to provide a desired trade off between reduction of visual artifacts and reduced power consumption. Additionally, the inversion techniques, electrode configurations and high impedance power reduction described above may be implemented in any suitable LCD panel type, such as IPS, FFS, TN, VA, etc.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method, comprising:

inverting the polarity of each consecutive two-line pair of an LCD panel during a frame refresh, wherein the inverting comprises:

driving a first line of a two-line pair of an LCD panel to a first common voltage via a first common line common to a first subset of a plurality of lines of the LCD panel;

switching a second line of the two-line pair to a high impedance state during the driving via a second common line common to a second subset of the plurality of lines of the LCD panel;

driving the second line of the two-line pair to a second common voltage via the second common line; and switching the first line of the two-line pair to a high impedance state via the first common line, and wherein inverting the polarity of every consecutive two line pair comprises switching each of a plurality of common electrodes of the LCD panel at a rate equal to one-half the total number of lines of the LCD panel multiplied by a refresh rate of the frame refresh.

2. The method of claim 1, wherein the first common voltage is substantially equal to the second common voltage.

3. The method of claim 1, wherein switching the second line of the two-line pair to a high impedance state comprises switching a common electrode coupled to the second line to the high impedance state.

4. The method of claim 3, wherein switching the common electrode to the high impedance state reduces or eliminates the current draw of the common electrode and a driver driving the common electrode.

5. The method of claim 1, wherein the first common line is located at a first end of the LCD panel, and the second common line is located at an opposite second end of the LCD panel.

6. A method, comprising:

inverting the polarity of each of consecutive two-line pair of consecutive lines of an LCD panel during a frame refresh, wherein the consecutive lines comprise even-numbered lines and odd-numbered lines arranged into groups of two or more adjacent lines, wherein the inverting comprises:

driving one of the even-numbered lines of the LCD panel to a first common voltage via a first common line common to the even-numbered lines of the LCD panel; and switching the odd-numbered lines of the LCD panel to a high impedance state during the driving via a second common line common to the odd-numbered lines of the LCD panel, and wherein inverting the polarity of each of consecutive two-line pair of consecutive lines during the frame refresh comprises switching each of a plurality of common electrodes of the LCD panel at a rate equal to one-half the total number of lines of the LCD panel multiplied by a refresh rate of the frame refresh.

7. The method of claim 6, comprising:

driving one of the odd-numbered lines of the LCD panel to a second common voltage via the second common line; and switching the even-numbered lines of the LCD panel to a high impedance state during the driving via the first common line.

8. The method of claim 7, comprising: inverting the polarity of each of consecutive two-line pair of consecutive lines of the LCD panel during a second frame of the frame refresh, wherein the inverting comprises:

driving one of the even-numbered lines of the LCD panel to the second common voltage via the first common line; and switching the odd-numbered lines of the LCD panel to a high impedance state during the driving.

9. The method of claim 7, wherein switching the even-numbered lines of the LCD panel to a high impedance state comprises floating a common electrode coupled to the even-numbered lines.

10. The method of claim 6, wherein switching the odd-numbered lines of the LCD panel to a high impedance state comprises floating a common electrode coupled to the odd-numbered lines.

11. An LCD panel, comprising:

a first electrode driver coupled to one or more common logical electrodes, wherein the first electrode driver is configured to switch to a high impedance state during an inversion of two or more adjacent lines of the LCD panel, wherein the inversion of two or more adjacent lines of the LCD panel comprises switching each of the one or more common logical electrodes of the LCD panel at a rate equal to the total number of lines of the LCD panel divided by the number of common logical electrodes and multiplied by a refresh rate of a frame refresh;

one or more groups of two or more adjacent lines coupled to the one or more logical common electrodes, wherein the number of lines of each of the one or more groups comprises the total number of lines of the LCD panel divided by the number of one or more groups;

a first common line configured to couple a first subset of the two or more adjacent lines to the first electrode driver and to alternate the first subset between a common voltage connection and a high impedance state; and a second common line configured to couple a second subset of the two or more adjacent lines to a second electrode driver and to alternate the subset between a common voltage connection and a high impedance state.

12. The LCD panel of claim 11, wherein each group comprises four lines of the LCD panel.

13. The LCD panel of claim 12, wherein each group is coupled to two logical common electrodes.

14. The LCD panel of claim 11, wherein the second subset comprises only lines not contained in the first subset.

15. The LCD panel of claim 11, wherein the first common line is located at a first end of the LCD panel, and the second common line is located at an opposite second end of the LCD panel.

16. A method, comprising: switching a polarity of an LCD panel during a frame refresh, wherein the switching comprises:

switching a polarity of a first group of lines of the LCD panel via a first common line coupled to the first group of lines, wherein the first group comprises a first line in each of a plurality of two-line pairs; and switching a second group of lines of the LCD panel to a high impedance state via a second common line coupled to the second group of lines during the switching of the polarity of the first group of lines, wherein the second group comprises a second line in each of the plurality of two-line pairs, and wherein switching the polarity of the first group of lines of the LCD panel comprises switching each of a plurality of common electrodes of the LCD panel at a rate equal to one-half the total number of lines of the LCD panel multiplied by a refresh rate of the frame refresh.

17. The method of claim 16, wherein switching the first group of lines comprises driving one or more logical common electrodes coupled to the first group of lines to a first common voltage.

18. The method of claim 17, wherein each pair of lines of the first group of lines is coupled to each of the one or more logical common electrodes.

19. The method of claim 17, wherein each line of the first group of lines is coupled to each of the one or more logical common electrodes.

20. The method of claim 16, comprising switching the polarity of the second group of lines.

21. The method of claim 20, comprising switching the first group of lines of the LCD panel to a high impedance state during the switching of the polarity of the second group of lines.

22. A method of operating an LCD panel, comprising:

switching a first common electrode driver of a driver circuit to a first common voltage, wherein the first common electrode driver is coupled to a first one or more lines of the LCD panel, wherein each of the first one or more lines is a first line of a two-line pair of lines in the LCD panel, wherein switching a first common electrode driver of a driver circuit comprises switching the first common electrode driver of the LCD panel at a rate equal to one-half the total number of lines of the LCD panel multiplied by a refresh rate of a frame refresh; and floating a second common electrode driver of a driver circuit, wherein the second common electrode driver is coupled to a second one or more lines of the LCD panel, wherein each of the second one or more lines is a second line of the two-line pair of the LCD panel.

23. The method of claim 22, wherein floating a second common electrode driver comprises disconnecting the second common electrode driver from the first common voltage and a second common voltage.

24. The method of claim 23, wherein disconnecting the second electrode driver comprises switching a switch coupled to the second electrode driver to an intermediate state such that the switch is electrically disconnected from the first common voltage and the second common voltage.

* * * * *